US010770772B2

(12) United States Patent
Suenaga et al.

(10) Patent No.: US 10,770,772 B2
(45) **Date of Patent: *Sep. 8, 2020**

(54) SIGNAL TRANSMISSION CABLE, MULTICORE CABLE, AND METHOD OF MANUFACTURING SIGNAL TRANSMISSION CABLE

(71) Applicant: Hitachi Metals, Ltd., Tokyo (JP)

(72) Inventors: Kazufumi Suenaga, Tokyo (JP); Yuju Endo, Tokyo (JP); Hideyuki Sagawa, Tokyo (JP); Takahiro Sugiyama, Tokyo (JP); Hiroshi Ishikawa, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 59 days.

This patent is subject to a terminal disclaimer.

(21) Appl. No.: 16/025,307

(22) Filed: Jul. 2, 2018

(65) Prior Publication Data

US 2019/0013560 A1 Jan. 10, 2019

(30) Foreign Application Priority Data

Jul. 4, 2017 (JP) ..... 2017-131094

(51) Int. Cl.
*H01P 3/06* (2006.01)
*H01P 11/00* (2006.01)
(Continued)

(52) U.S. Cl.
CPC ..... *H01P 3/06* (2013.01); *H01B 11/1817* (2013.01); *H01B 13/003* (2013.01); *H01B 13/0167* (2013.01); *H01B 13/06* (2013.01); *H01P 3/02* (2013.01); *H01P 11/005* (2013.01); *H01B 3/441* (2013.01); *H01B 11/20* (2013.01)

(58) Field of Classification Search
CPC combination set(s) only.
See application file for complete search history.

(56) References Cited

U.S. PATENT DOCUMENTS 3,748,372 A * 7/1973 McMahon ..... H01B 3/20 174/25 C
4,234,759 A * 11/1980 Harlow ..... H01B 7/0838 174/103

(Continued)

FOREIGN PATENT DOCUMENTS

JP 2002203437 A * 7/2002
JP 2002289047 10/2002
JP 2005149892 A * 6/2005

*Primary Examiner* — Binh B Tran
*Assistant Examiner* — Krystal Robinson
(74) *Attorney, Agent, or Firm* — Meunier Carlin & Curfman LLC

(57) ABSTRACT

A signal transmission cable includes a signal line, an insulation layer configured to cover the signal line, and a plating layer configured to cover the insulation layer. An arithmetic average roughness Ra of an outer peripheral surface of the insulation layer is between 0.6 μm and 10 μm inclusive. A method of manufacturing the signal transmission cable includes covering the signal line with the insulation layer, followed by conducting a dry-ice-blasting on the outer peripheral surface of the insulation layer, followed by conducting a corona discharge exposure process on the outer peripheral surface, and forming the plating layer on the outer peripheral surface.

20 Claims, 23 Drawing Sheets

(51) Int. Cl.

| | |
|---|---|
| ***H01B 13/00*** | (2006.01) |
| ***H01B 13/016*** | (2006.01) |
| ***H01B 13/06*** | (2006.01) |
| ***H01B 11/18*** | (2006.01) |
| ***H01P 3/02*** | (2006.01) |
| *H01B 3/44* | (2006.01) |
| *H01B 11/20* | (2006.01) |

(56) References Cited

U.S. PATENT DOCUMENTS 4,281,212 A * 7/1981 Bogese, II ..... H01B 7/0823 174/103
4,314,737 A * 2/1982 Bogese ..... H01B 7/0823 439/425
4,487,991 A * 12/1984 Forsyth ..... H01B 9/0611 174/110 PM
5,012,125 A * 4/1991 Conway ..... H01B 9/028 174/120 SC
5,372,886 A * 12/1994 Inazawa ..... H01B 3/105 174/110 A
5,729,646 A * 3/1998 Miyagi ..... A61B 18/201 385/125
6,194,666 B1 * 2/2001 Hayashida ..... F16C 1/10 174/128.1
6,317,543 B1 * 11/2001 Sheu ..... G02B 6/4433 385/114
6,521,695 B1 * 2/2003 Peruzzotti ..... C08K 5/04 524/505
9,159,472 B2 * 10/2015 Nordin ..... H01B 11/203
2003/0044606 A1 * 3/2003 Iskander ..... C09J 123/06 428/375
2004/0026101 A1 2/2004 Ochi
2005/0265677 A1 * 12/2005 Hongo ..... G02B 6/032 385/123
2006/0121738 A1 * 6/2006 Egitto ..... H05K 3/384 438/694
2009/0229850 A1 * 9/2009 Cases ..... H01B 11/20 174/102 R
2011/0226507 A1 * 9/2011 Ueda ..... H01B 11/1817 174/106 R
2012/0220465 A1 * 8/2012 Tanaka ..... H01L 39/141 505/231
2015/0162113 A1 * 6/2015 Ishikawa ..... H01B 11/002 174/108
2016/0111187 A1 * 4/2016 Kodama ..... H05K 1/0245 333/5
2016/0180986 A1 * 6/2016 Jo ..... C09D 183/08 174/120 C
2017/0361789 A1 * 12/2017 Ohgushi ..... H01B 7/17
2019/0228877 A1 * 7/2019 Sagawa ..... H01B 7/1885

* cited by examiner

SIGNAL TRANSMISSION CABLE, MULTICORE CABLE, AND METHOD OF MANUFACTURING SIGNAL TRANSMISSION CABLE

CROSS-REFERENCE TO RELATED APPLICATIONS

This application claims the benefit of Japanese Patent Application No. 2017-131094 filed Jul. 4, 2017 in the Japan Patent Office, the disclosure of which is incorporated herein by reference.

BACKGROUND

The present disclosure relates to a signal transmission cable, a multicore cable, and a method of manufacturing the signal transmission cable.

Signal transmission cables are conventionally used for signal transmissions between electronic devices, or signal transmissions between substrates in electronic devices. Signal transmission cable comprises, for example, a signal line, an insulation layer that covers the signal line, and an external conductor that covers the insulation layer as disclosed in JP 2002-289047 (Patent Document 1). The external conductor is formed by, for example, winding a metallic tape or a metallic braid around an outer circumference of the insulation layer.

SUMMARY

There has been a problem with the conventional signal transmission cable that a gap is occassionally created between the insulation layer and the external conductor. Such a gap may reduce a shielding effect by the external conductor to an unsatisfactory level.

Aspects of the present disclosure provide a signal transmission cable, a multicore cable, and a method of manufacturing the signal transmission cable that can reduce a gap between an insulation layer and an external conductor.

One mode of the present disclosure is a signal transmission cable that comprises a signal line, an insulation layer configured to cover the signal line, and a plating layer configured to cover the insulation layer. An arithmetic average roughness Ra of an outer peripheral surface of the insulation layer is between 0.6 μm and 10 μm inclusive.

In a signal transmission cable according to a first aspect of the present disclosure, the arithmetic average roughness Ra of the outer peripheral surface of the insulation layer is 0.6 μm or greater. This results in high adhesion between the insulation layer and the plating layer, which then reduces occurrence of a gap between the insulation layer and the plating layer. As a consequence, a high shielding effect by the plating layer is provided. At the same time, transmission loss can be reduced since the arithmetic average roughness Ra of the outer peripheral surface of the insulation layer is 10 μm or less.

A second aspect of the present disclosure provides a multicore cable comprising signal transmission cables, a conductor layer configured to cover the signal transmission cables collectively, and a jacket configured to cover the conductor layer. Each of the signal transmission cables in the multicore cable comprises the signal transmission cable according to the first aspect of the present disclosure, and an outer insulation layer configured to cover the plating layer.

In the signal transmission cables of the multicore cable according to the second aspect of the present disclosure, the arithmetic average roughness Ra of the outer peripheral surface of the insulation layer is 0.6 μm or greater. This results in high adhesion between the insulation layer and the plating layer, which then reduces occurrence of a gap between the insulation layer and the plating layer. As a consequence, a high shielding effect by the plating layer is provided. At the same time, transmission loss can be reduced since the arithmetic average roughness Ra of the outer peripheral surface of the insulation layer is 10 μm or less.

A third aspect of the present disclosure provides a method of manufacturing the signal transmission cable comprising a signal line, an insulation layer configured to cover the signal line, and a plating layer configured to cover the insulation layer. The method comprises applying a dry-ice-blasting to an outer peripheral surface of the insulation layer, then applying a corona discharge exposure process to the outer peripheral surface, and then forming the plating layer on the outer peripheral surface.

With the method of manufacturing the signal transmission cable according to the third aspect of the present disclosure, the arithmetic average roughness Ra of the outer peripheral surface of the insulation layer can be increased to enhance the surface-wettability. Accordingly, a manufactured signal transmission cable has high adhesion between the insulation layer and the plating layer, which reduces occurrence of a gap between the insulation layer and the plating layer. As a consequence, a high shielding effect by the plating layer is provided.

BRIEF DESCRIPTION OF THE DRAWINGS

Example embodiments of the present disclosure will be described hereinafter with reference to the accompanying drawings, in which.

DETAILED DESCRIPTION OF THE PREFERRED EMBODIMENTS

Hereinafter, embodiments of the present disclosure will be explained.

1. SIGNAL TRANSMISSION CABLE

(1-1) Basic Configuration of Signal Transmission Cable

A signal transmission cable in the present disclosure comprises a signal line, an insulation layer configured to cover the signal line, and a plating layer configured to cover the insulation layer. The signal transmission cable in the present disclosure may be, for example, a differential signal transmission cable or other types of signal transmission cables. A differential signal transmission cable comprises two signal lines.

In a case where the signal transmission cable in the present disclosure is provided as a differential signal transmission cable, a signal can be transmitted to a receiving device by a differential signal. In the signal transmission using the differential signal, signals having phases opposite to each other are input to the two signal lines respectively. The receiving device synthesizes the difference between the two signals having the opposite phases to obtain an output.

Figure 1:
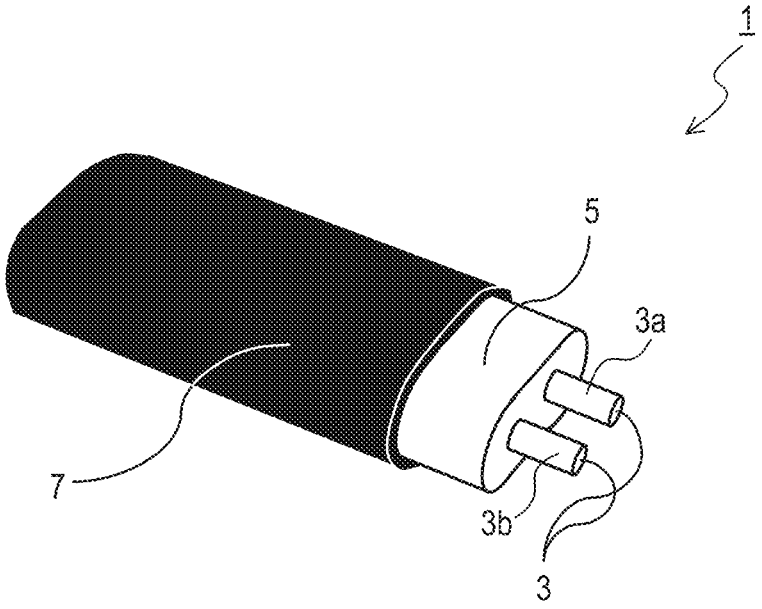
FIG. 1 is a perspective view showing a configuration of a signal transmission cable 1.

The signal transmission cable in the present disclosure has, for example, a configuration shown in FIG. 1. The example of the signal transmission cable shown in FIG. 1 is an example of the differential signal transmission cable. As shown in FIG. 1, a signal transmission cable 1 comprises a first and second signal lines 3*a* and 3*b*, an insulation layer 5, and a plating layer 7. The insulation layer 5 covers the first and second signal lines 3*a* and 3*b*. As shown in FIG. 1, the insulation layer 5 covers the first and second signal lines 3*a* and 3*b* collectively. Each of the first and second signal lines 3*a* and 3*b* may be made of strands, for example, and may be a twisted wire made by twisting strands. The first and second signal lines 3*a* and 3*b* have improved flexibility if they are the twisted wires.

In the case where the signal transmission cable of the present disclosure is the differential signal transmission cable, it is preferable that the maximum value of a differential-to-common mode conversion energy is −26 dB or less in a frequency band of 50 GHz and below. The differential-to-common mode conversion energy is measured before winding the differential signal transmission cable around a drum or the like. In the signal transmission cable in the present disclosure, occurrence of a gap between the plating layer and the insulation layer is reduced. Therefore, the differential-to-common mode conversion energy can be reduced when the signal transmission cable in the present disclosure is provided as the differential signal transmission cable.

The signal transmission cable in the present disclosure may be used for, for example, signal transmission between electronic devices or signal transmission between substrates in an electronic device. Examples of the electronic devices comprise, for example, servers, routers and storage devices handling high-speed signal transmission of several Gbps or more. The signal transmission cable in the present disclosure may be also used as an acoustic cable, for example. The signal transmission cable in the present disclosure transmits a high-speed signal of, for example, 25 GHz and above.

(1-2) Insulation Layer

In a case where the signal transmission cable in the present disclosure comprises two signal lines, it is preferable that the insulation layer covers the two signal lines collectively. To cover the two signal lines collectively means to cover both of the two signal lines together with a single body of insulation layer. In a case where the two signal lines are covered collectively by one insulation layer, there will be no gap between separate insulation layers, as would be the case when each signal line is covered by a separte insulation layer. This helps reduce variation of dielectric constant along a longitudinal axis of the signal transmission cable. Consequently, the differential-to-common mode conversion energy can be further reduced in the case where the signal transmission cable in the present disclosure is provided as the differential signal transmission cable.

Further in the case where the insulation layer covers the two signal lines collectively, the plating layer can be more uniformly formed on an outer peripheral surface of the insulation layer. Nevertheless, the first signal line and the second signal line of the two signal lines may be covered individually by separate insulation layers.

Preferably, the shape of the outer periphery of the insulation layer may be oval or elliptical on a section orthogonal to an axis of extension of the signal line. This helps form the plating layer uniformly over the entire outer peripheral surface of the insulation layer. Furthermore, it becomes easier to perform surface roughening and surface improvement uniformly across the entire outer peripheral surface of the insulation layer. The oval shape includes a shape that comprises two parallel straight lines, and two arcs each connecting two ends of the straight lines.

The arithmetic average roughness Ra of the outer peripheral surface of the insulation layer is 0.6 μm or greater. This helps increase adhesion between the plating layer and the insulation layer, and also helps reduce peeling of the plating layer from the insulation layer. Also, due to the improved adhesion between the insulation layer and the plating layer, occurrence of a gap between the insulation layer and the plating layer is reduced. Consequently, a high shielding effect is exerted by the plating layer. In the case where the signal transmission cable is the differential signal transmission cable, the differential-to-common mode conversion energy can be further reduced.

A method of providing the outer peripheral surface of the insulation layer having the arithmetic average roughness Ra of 0.6 μm or greater may include surface roughening treatment, such as blasting, immersion in an acidic or alkaline solution, immersion in a chromic acid solution, and immersion in a chelate solution.

Fine particles to be sprayed against an object of blasting includes, for example, dry ice, metallic particles, carbon particles, oxide particles, carbide particles, and nitride particles. Dry ice particles are preferred since they do not tend to remain in the insulation layer after the blasting.

In the blasting, the arithmetic average roughness Ra of the outer peripheral surface of the insulation layer increases as the speed for spraying the fine particle is increased. The arithmetic average roughness Ra of the outer peripheral surface of the insulation layer increases as the duration of the blasting lengthens. The arithmetic average roughness Ra of the outer peripheral surface of the insulation layer increases as the distance between a tip of a nozzle to spray the fine particles and the outer peripheral surface of the insulation layer is shortened.

The arithmetic average roughness Ra of the outer peripheral surface of the insulation layer may preferably be 10 μm or less, or more preferably 5 μm or less. A transmission loss can be reduced when the arithmetic average roughness Ra of the outer peripheral surface of the insulation layer is 10 μm or less.

A method of measuring the arithmetic average roughness Ra may comprise, for example, a use of a laser microscope VK8500 by Keyence Corporation. An example of specific measuring conditions are explained below. That is, two positions opposite to each other on the outer peripheral surface of the insulation layer are chosen. The two positions are flat or have the smallest curvature (hereinafter, the two positions are referred to as a first measuring position and a second measuring position). The "curvature" here may be a curvature of the outer peripheral surface of the insulation layer taken orthogonally to the longitudinal axis of the cable, for example. In addition, the "two positions having the smallest curvature" here may be, for example, "two positions that provide the least average curvature". The curvature is the inverse number of the radius of curvature; thus the least curvature corresponds to the greatest radius of curvature. A measuring area at the first measuring position is determined. The measuring area has a shape of a rectangle having length of 150 μm along the longitudinal axis of the cable and length of 120 μm along the circumference of the cable. The measuring area in the shape of a rectangle at the first measuring position may be, for example, a rectangular measuring area with the first measuring position situated at the center thereof or a rectangular measuring area that comprises the first measuring position. A first arithmetic average roughness Ra is measured in the determined measuring area by using the aforementioned laser microscope. A second arithmetic average roughness Ra is measured at the second measuring position likewise. Lastly, an average value of the first arithmetic average roughness Ra at the first measuring position and the second arithmetic average roughness Ra at the second measuring position is calculated. The calculated average value is used as the arithmetic average roughness Ra of the outer peripheral surface of the insulation layer. The arithmetic average roughness Ra is obtained before forming the plating layer.

Through the following test (hereinafter called a first test), it was confirmed that peeling of the plating layer from the insulation layer can be reduced when the arithmetic average roughness Ra of the outer peripheral surface of the insulation layer is 0.6 μm or greater. Firstly, a polyethylene (PE) substrate was prepared. This substrate corresponds to the insulation layer. Blasting using dry ice as the fine particles (hereinafter called dry-ice-blasting) was applied to the substrate. The dry-ice-blasting corresponds to the surface roughening treatment. The arithmetic average roughness Ra of the surface of the substrate was 0.6 μm or greater after the dry-ice-blasting. Then, a corona discharge exposure process was performed on the substrate as surface modification treatment. Examples of the surface modification treatment may comprise electron beam irradiation, ion irradiation, the corona discharge exposure, plasma exposure, ultraviolet irradiation, X-ray irradiation, γ-ray irradiation, and immersion in ozone-containing liquid. An adhesion-wetting surface free energy of the surface of the substrate after the corona discharge exposure process was 66 $mJ/m^2$ or greater and the contact angle was 95° or greater. A method of measuring the adhesion-wetting surface free energy will be explained later.

Figure 2A:
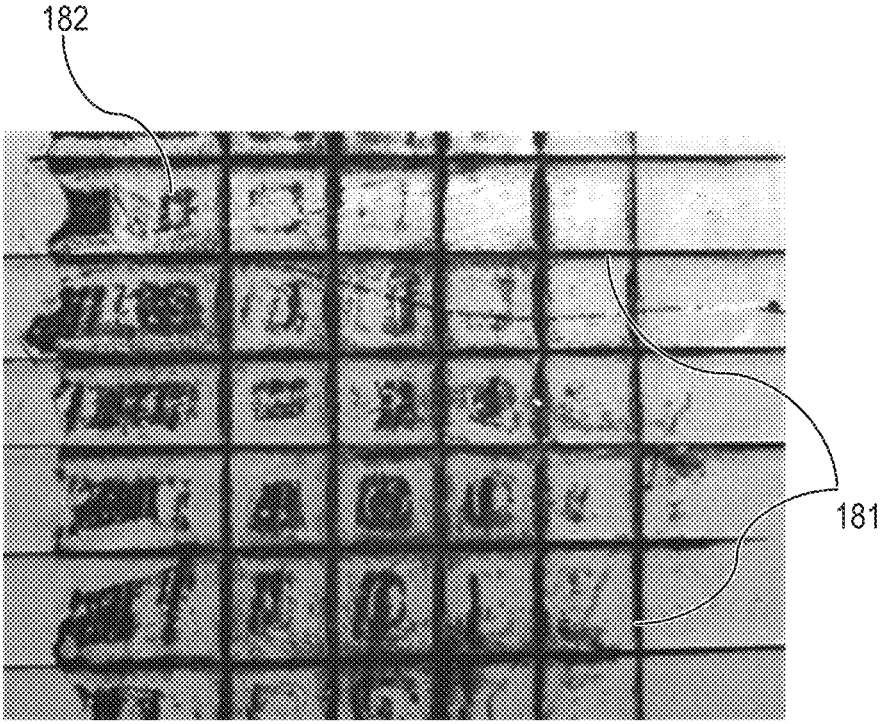
FIG. 2A is a micrograph showing a result of an adhesion test of a comparative example.
Figure 2B:
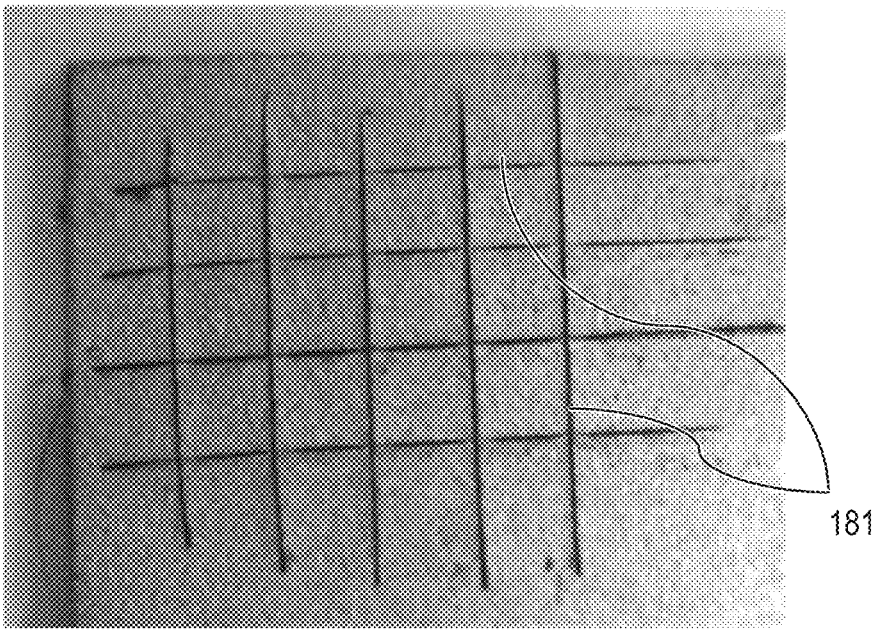
FIG. 2B is a micrograph showing a result of an adhesion test of a first embodiment.

After the corona discharge exposure process, a copper plating layer was formed on the surface of the substrate by an electroless plating method. Then, cuts were made on the copper plating layer in a checkerboard pattern. The cuts penetrated through the copper plating layer and reached the substrate. An adhesive tape was attached to the copper plating layer and then removed. FIG. 2B shows the copper plating layer when the adhesive tape was removed. In FIG. 2B, reference numeral 181 indicates the cuts. No peeling of the copper plating layer occurred in any section of the checkerboard pattern. This explains that the adhesion performance between the copper plating layer and the substrate was high.

A comparative example was tested basically by a similar method. No surface roughening treatment or no surface modification treatment were applied to a substrate of the comparative example. The arithmetic average roughness Ra of a surface of the substrate was 0.13 μm. FIG. 2A shows the copper plating layer of the comparative example when the adhesive tape was removed. The checkerboard pattern had 20 sections. Peeling of the copper plating layer was found in 17 sections, and there occurred portions 182 where the substrate was exposed. This explains that the adhesion performance between the copper plating layer and the substrate was low in the comparative example.

Preferably, the contact angle on the outer peripheral surface of the insulation layer may be 95° or less. This helps easily make the thickness of the plating layer uniform. Uniform thickness of the plating layer can reduce the transmission loss of the signal transmission cable.

A method of making the contact angle on the outer peripheral surface of the insulation layer at 95° or less may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid.

In any of the aforementioned treatments, the contact angle decreases as the intensity of treatment is increased, and the contact angle decreases as the duration of treatment is lengthened. A method of increasing a surface modification effect by the corona discharge exposure may comprise, for example, increase of voltage and increase of oxygen concentration in the atmosphere of the corona discharge. A method of measuring the contact angle is to drop a droplet of water having a diameter of 1.5 mm on the outer peripheral surface of the insulation layer and read the contact angle. The contact angle is obtained before forming the plating layer.

Preferably, an absolute value of the adhesion-wetting surface free energy on the outer peripheral surface of the insulation layer may be 66 $mJ/m^2$ or greater. This helps easily make the thickness of the plating layer uniform. Uniform thickness of the plating layer reduces the transmission loss of the signal transmission cable.

A method of providing the outer peripheral surface of the insulation layer with the absolute value of the adhesion-wetting surface free energy thereon of 66 $mJ/m^2$ or greater may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid.

In any of the aforementioned treatments, the absolute value of the adhesion-wetting surface free energy can be increased as the intensity of treatment is increased, and the absolute value of the adhesion-wetting surface free energy can be increased as the duration of treatment is lengthened.

An absolute value of an adhesion-wetting surface free energy ΔG is calculated by the following Formula 3.

$$|\Delta G| = |-\gamma_{LG}(\cos\theta + 1)| \quad \text{[Formula 3]}$$

The $\gamma_{LG}$ in Formula 3 is a constant value, which is 72.75 $mJ/m^2$. The value θ is the contact angle on the outer peripheral surface of the insulation layer. The adhesion-wetting surface free energy ΔG is obtained before forming the plating layer.

Through the following test, it was confirmed that the plating layer can be uniformly formed when the contact angle on the outer peripheral surface of the insulation layer is 95° or less or when the absolute value of the adhesion-wetting surface free energy is 66 $mJ/m^2$ or greater.

Figure 3A:
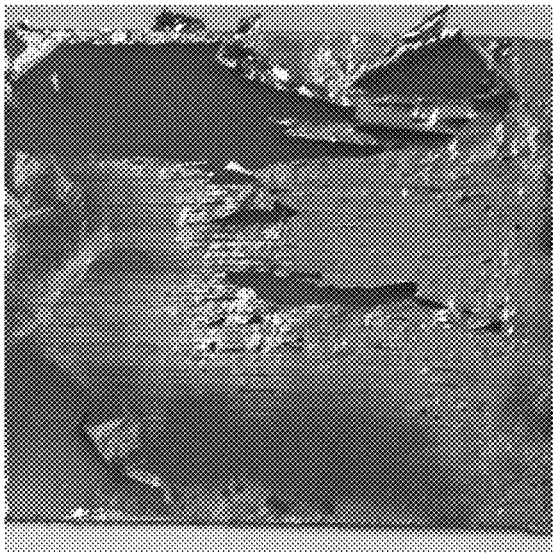
FIG. 3A is a micrograph showing a state of a surface of a copper plating layer formed on the comparative example.
Figure 3B:
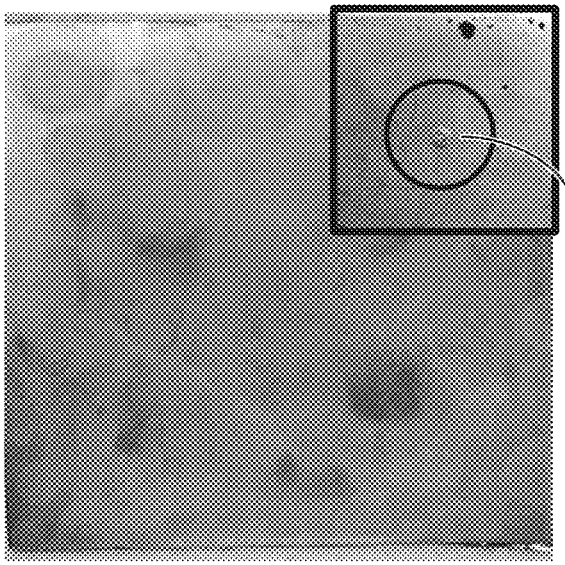
FIG. 3B is a micrograph showing a state of a surface of a copper plating layer formed on a reference example.
Figure 3C:
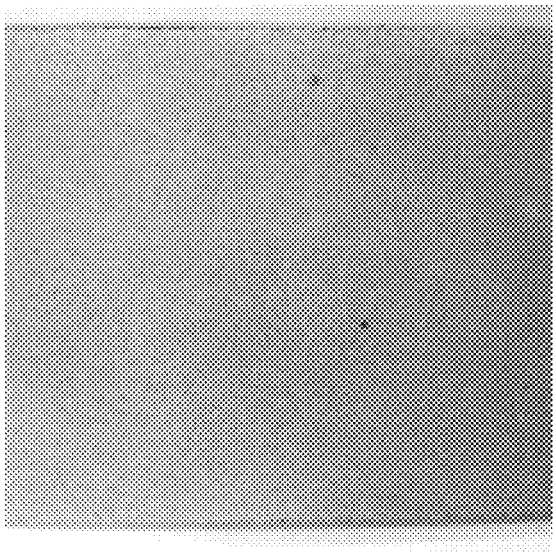
FIG. 3C is a micrograph showing a state of a surface of a copper plating layer formed after dry-ice-blasting and corona discharge exposure.

Firstly, a polyethylene substrate was prepared. This substrate corresponds to the insulation layer. The dry-ice-blasting was applied to the substrate, and then the corona discharge exposure process was applied to the substrate. The dry-ice-blasting corresponds to the surface roughening treatment. The corona discharge exposure process corresponds to the surface modification treatment. After the corona discharge exposure process, the arithmetic average roughness Ra of the surface of the substrate was 0.6 μm or greater, the absolute value of the adhesion-wetting surface free energy on the surface of the substrate was 66 $mJ/m^2$ or greater, and the contact angle was 95° or less. Then, the copper plating layer was formed on the surface of the substrate by an electroplating method. The thickness of the copper plating layer was set to be three times thicker than the copper plating layer formed in the first test. FIG. 3C shows the formed copper plating layer. The copper plating layer was formed uniformly. The adhesion performance between the copper plating layer and the substrate was high so that no peeling of the copper plating layer occurred.

A comparative example was prepared basically by a similar method. In the comparative example, the arithmetic average roughness Ra of the surface of the substrate was less than 0.6 μm after the surface roughening treatment. After the surface modification treatment, the absolute value of the adhesion-wetting surface free energy on the surface of the substrate was 66 $mJ/m^2$ or greater, and the contact angle was 95° or less. FIG. 3A shows the copper plating layer formed in the comparative example. Significant peeling of the copper plating layer occurred.

A reference example was also prepared basically by a similar method. In the reference example, the arithmetic average roughness Ra of the surface of the substrate was 0.6 μm or greater after the surface roughening treatment. After the surface modification treatment, the absolute value of the adhesion-wetting surface free energy on the surface of the substrate was less than 66 $mJ/m^2$, and the contact angle was greater than 95°. FIG. 3B shows the copper plating layer formed in the reference example. No peeling of the copper plating layer occurred. However, a plating failure bulge 191 called a blister existed in the surface of the copper plating layer and the plated surface was not uniform.

With the process of first applying the dry-ice-blasting to the outer peripheral surface of the insulation layer and then conducting the surface modification treatment by the corona discharge exposure process (hereinafter called a specific surface modification treatment), the arithmetic average roughness Ra of the outer peripheral surface of the insulation layer and the contact angle or the absolute value of the adhesion-wetting surface free energy can be controlled. This was confirmed by the following test. The dry-ice-blasting corresponds to the surface roughening treatment. The corona discharge exposure process corresponds to the surface modification treatment.

Figure 4:
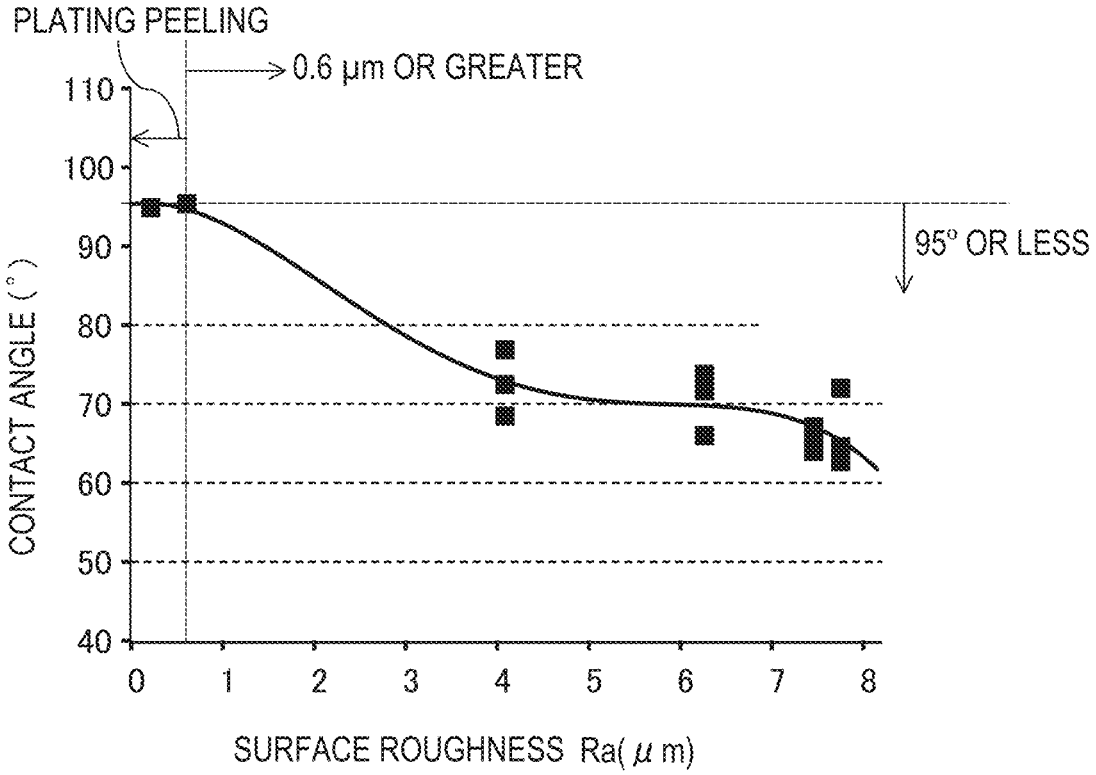
FIG. 4 is a graph showing a correlation between an arithmetic average roughness Ra and a contact angle of a polyethylene substrate after specific surface modification treatment.

The specific surface modification treatment was applied to a polyethylene substrate. The substrate corresponds to the insulation layer. There are several conditions for the specific surface modification treatment. FIG. 4 shows a correlation between the arithmetic average roughness Ra and the contact angle after the specific surface modification treatment is applied. The arithmetic average roughness Ra of 0.6 μm or greater and the contact angle of 95° or less were achieved by conducting the specific surface modification treatment.

Figure 5:
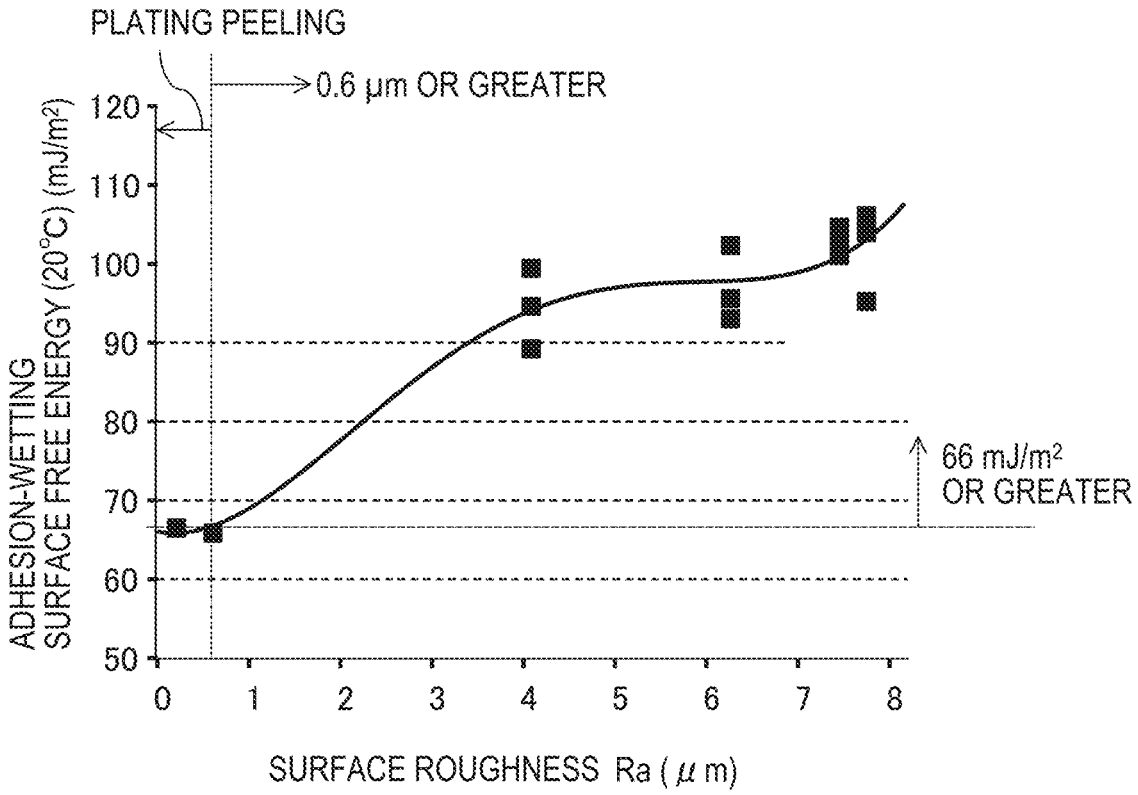
FIG. 5 is a graph showing a correlation between an arithmetic average roughness Ra and an adhesion-wetting surface free energy of a polyethylene substrate after specific surface modification treatment.

FIG. 5 shows a correlation between the arithmetic average roughness Ra and the adhesion-wetting surface free energy after the specific surface modification treatment is applied. The arithmetic average roughness Ra of 0.6 μm or greater and the absolute value of the adhesion-wetting surface free energy of 66 $mJ/m^2$ or greater were achieved by conducting the specific surface modification treatment.

Preferably, the outer peripheral surface of the insulation layer may have concavities. This helps reduce occurrence of peeling of the plating layer from the insulation layer. The concavity preferably may have, at its bottom in the depth direction, a space that is wider than an opening of the concavity. In this case, following effects can be exerted. That is, a plating liquid reacheds the bottom of the concavity when forming a plating layer in a plating bath. This then generates nucleus at the bottom of the concavity, causing growth of the plating layer also at the bottom of the concavity. The plating layer grown at the bottom of the concavity is wider than the opening of the concavity and thus unlikely to come out from the opening. Thus, an anchoring effect is exerted, and peeling of the plating layer from the insulation layer becomes less likely to happen.

Figure 6:
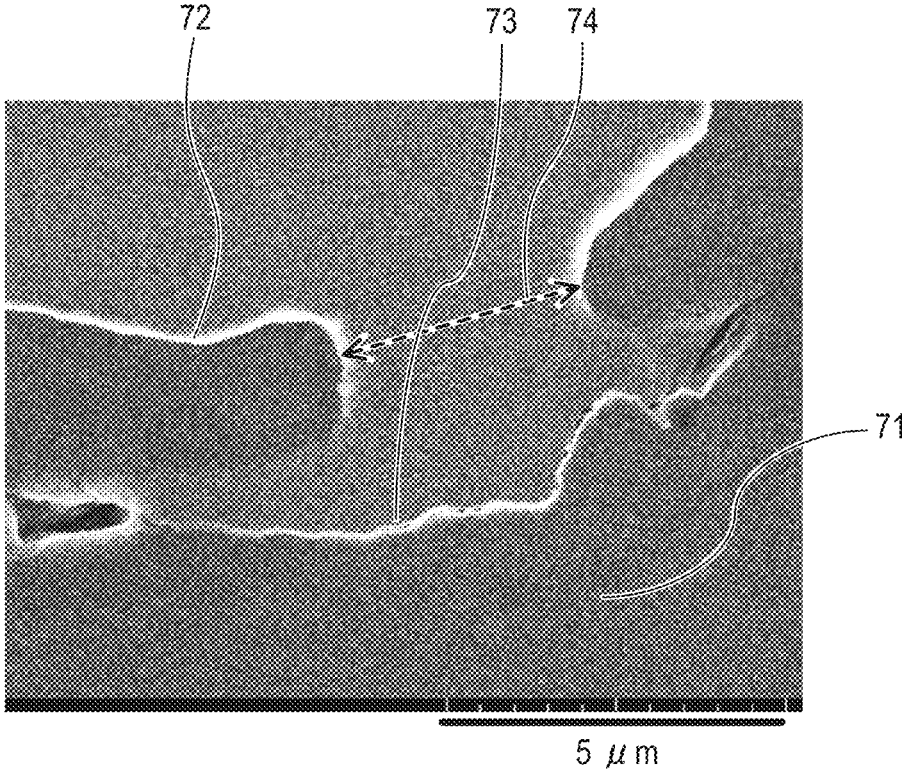
FIG. 6 is a micrograph showing a concavity formed on an outer peripheral surface of an insulation layer after dry-ice-blasting.

A method of forming concavities in the insulation layer may comprise blasting. For example, the dry-ice-blasting can be used as the blasting. The dry-ice-blasting corresponds to the surface roughening treatment. FIG. 6 shows an example of a concavity formed in the outer peripheral surface of the insulation layer by the dry-ice-blasting. FIG. 6 is a sectional view taken near an outer peripheral surface 72 of an insulation layer 71. A concavity 73 is formed in the outer peripheral surface 72. The concavity 73 comprises a space at its bottome in the depth direction that is wider than an opening 74 of the concavity 73. The shape of the concavity 73 is similar to an octopus pot. In the example shown in FIG. 6, the insulation layer 71 is made of polyethylene.

The material of the insulation layer may be selected from, for example, polytetrafluoroethylene (PTFE), perfluoroalkoxy (PFA), perfluoroethylene-propene copolymer (FEP), ethylene tetrafluoroethylene copolymer (ETFE), tetrafluoroethylene-perfluorodioxole copolymer (TFE/PDD), polyvinylidene fluoride (PVDF), polychlorotrifluoroethylene (PCTFE), ethylene-chlorotrifluoroethylene copolymer (ECTFE), polyvinyl fluoride (PVF), silicone, and polyethylene (PE).

The material of the insulation layer may be a foamable resin. In this case, the dielectric constant and a dielectric loss tangent of the insulation layer decrease. A method of manufacturing the insulation layer from the foamable resin may comprise, for example, mixing and kneading the resin with a foaming agent and foaming the kneaded material by controlling temperature and pressure when molding the insulation layer. Another manufacturing method of the insulation layer from the foamable resin may comprise, for example, injecting nitrogen gas or other gas into the resin when high-pressure molding the insulation layer and then reducing the pressure to create foams.

The insulation layer may also be manufactured from the foamable resin as described below. An extrusion die having a desired shape is placed in an extruder, and the signal line is extruded together with the foamable resin from the extruder, thereby forming the insulation layer with the foamable resin.

Preferably, the insulation layer may be made of polyethylene for example, and a crystallinity $X_c$ defined by the following Formulal 1 may be 0.744 or greater. This makes it easy to provide uniform thickness of the plating layer. Uniform thickness of the plating layer helps reduce the transmission loss of the signal transmission cable.

$$X_c = \frac{I_c}{I_c + I_a} \quad \text{[Formula 1]}$$

$I_c$ in Formula 1 is X-ray diffraction intensity of a crystalline component, and $I_a$ is X-ray diffraction intensity of a noncrystalline component.

A method of making the crystallinity $X_c$ of the polyethylene insulation layer be 0.744 or greater may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid. In any of the aforementioned treatment, the crystallinity $X_c$ can be increased as the intensity of treatment is increased, and the crystallinity $X_c$ can be increased as the duration of treatment is lengthened.

Figure 7:
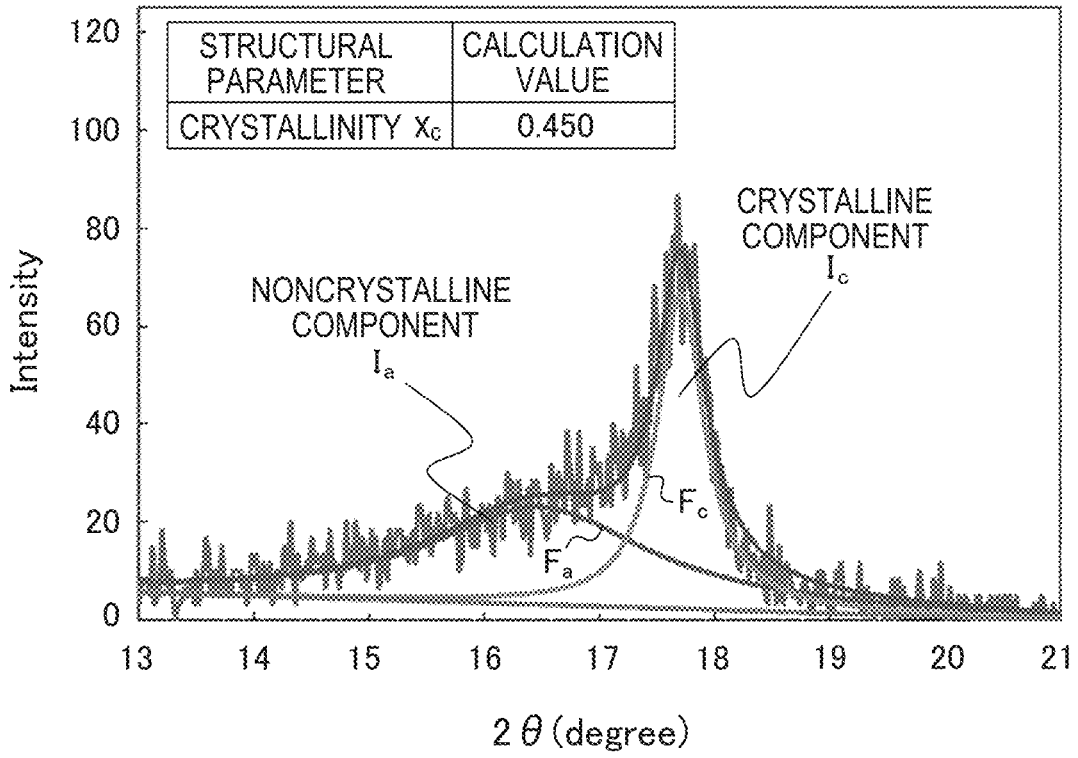
FIG. 7 is an X-ray diffraction pattern of an insulation layer specimen.
Figure 8:
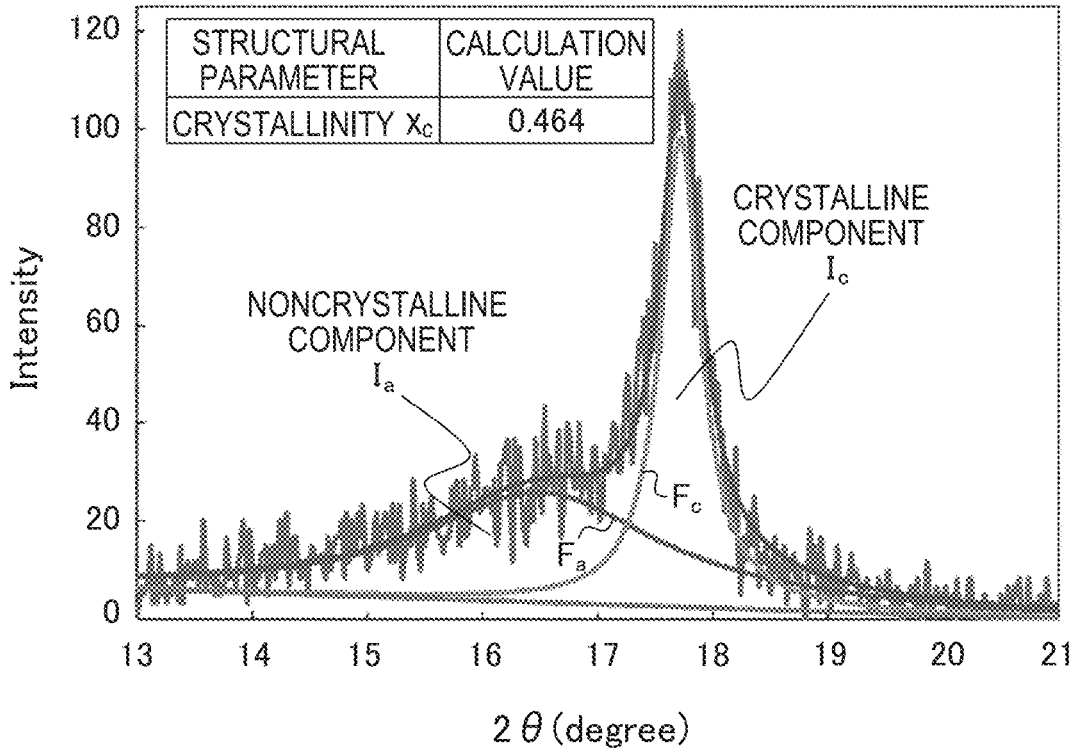
FIG. 8 is an X-ray diffraction pattern of an insulation layer specimen.

$I_c$ and $I_a$ in Formula 1 are calculated as follows. An X-ray diffraction pattern of an insulation layer specimen is obtained by using, for example, an X-ray diffraction apparatus RINT2500 by Rigaku Corporation. FIG. 7 and FIG. 8 show example X-ray diffraction patterns. In the X-ray diffraction patterns shown in FIG. 7 and FIG. 8, the horizontal axes are diffraction angle 2θ. The range of the diffraction angle 2θ in these X-ray diffraction patterns is between 13° and 21° inclusive.

In these X-ray diffraction patterns, a broad halo (hereinafter called a noncrystalline halo) that has a diffraction peak near 16.4° to 16.5° corresponds to the noncrystalline component. Sharp spectra (hereinafter called crystalline component spectra) that have a diffraction peak at 17.7° corresponds to the crystalline component.

Spectral fitting using the Lorentzian function is applied to the noncrystalline halo to obtain a smooth curve $F_a$ that satisfactorily matches the noncrystalline halo. The obtained curve $F_a$ is shown in FIG. 7 and FIG. 8. The intensity of the noncrystalline halo obtained by calculation of integrated intensity based on the curve $F_a$, is denoted with $I_a$.

Spectral fitting using the Lorentzian functions is applied to the crystalline component spectra to obtain a smooth curve $F_c$ that satisfactorily matches the crystalline component spectra. The obtained curve $F_c$ is shown in FIG. 7 and FIG. 8. The intensity of noncrystalline component spectra obtained by the calculation of integrated intensity based on this curve $F_c$, is denoted with $I_c$. The crystallinity $X_c$ is obtained before forming the plating layer.

Preferably, the insulation layer may be made of FEP for example, and the crystallinity $X_c$ of the insulation layer expressed in the following Formula 1 may be 0.47 or less. This helps provide uniform thickness of the plating layer. Uniform thickness of the plating layer helps reduce the transmission loss of the signal transmission cable.

$$X_c = \frac{I_c}{I_c + I_a} \quad \text{[Formula 1]}$$

$I_c$ in Formula 1 is the X-ray diffraction intensity of the crystalline component, and $I_a$ is the X-ray diffraction intensity of the noncrystalline component. $I_c$ and $I_a$ are calculated by the aforementioned method. The crystallinity $X_c$ is obtained before forming the plating layer.

A method of making the crystallinity $X_c$ of the FEP insulation layer be 0.47 or less may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid. In any of the aforementioned treatment, the crystallinity $X_c$ can be increased as the intensity of treatment is increased, and the crystallinity $X_c$ can be increased as the duration of treatment is lengthened.

Figure 9A:
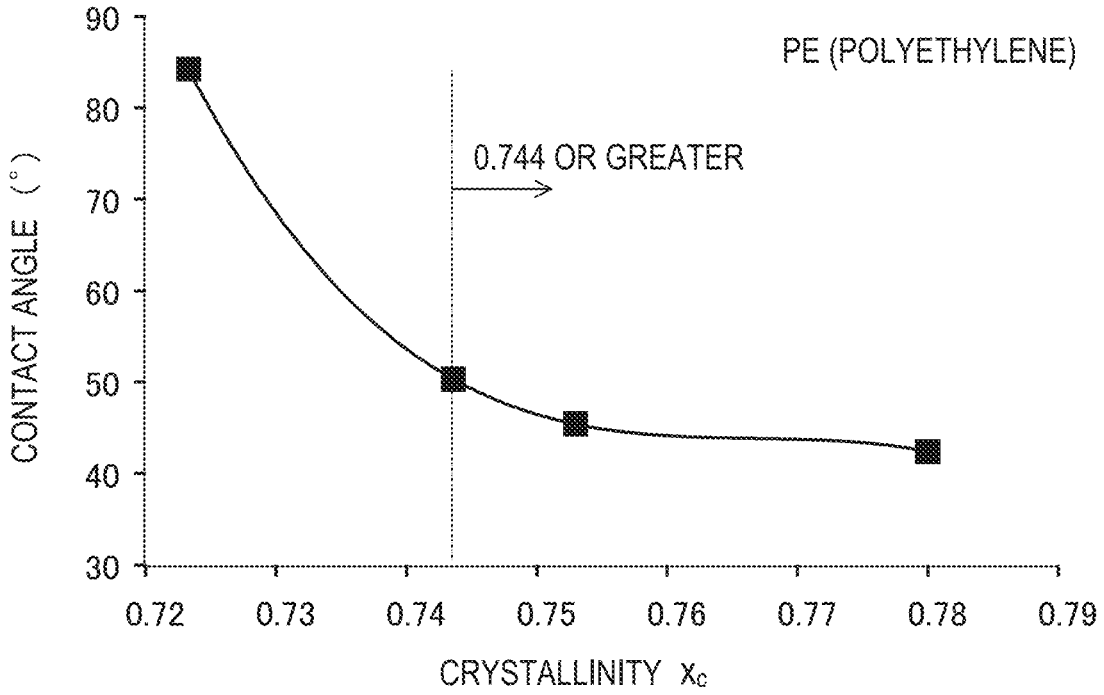
FIG. 9A is a graph showing a correlation between a crystallinity $X_c$ and a contact angle of a polyethylene substrate after specific surface modification treatment.

Through the following test, it was confirmed that there is a correlation between the crystallinity $X_c$ and the contact angle. The specific surface modification treatment was applied to the polyethylene substrate. The substrate corresponds to the insulation layer. There are several conditions for the specific surface modification treatment. FIG. 9A shows the correlation between the crystallinity $X_c$ and the contact angle after the specific surface modification treatment is applied. The contact angle became significantly small when the crystallinity $X_c$ was 0.744 or greater.

Figure 9B:
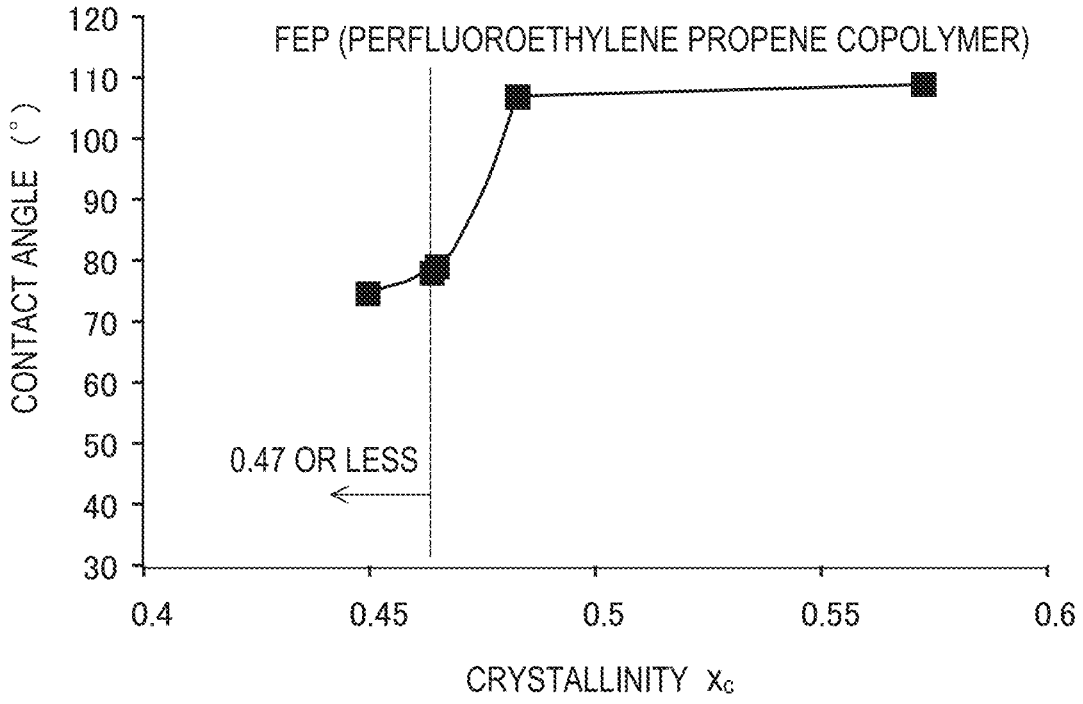
FIG. 9B is a graph showing a correlation between a crystallinity $X_c$ and a contact angle of a perfluoroethylene-propene copolymer substrate after specific surface modification treatment.

The specific surface modification treatment was applied to the FEP substrate. The substrate corresponds to the insulation layer. There are several conditions for the specific surface modification treatment. FIG. 9B shows the correlation between the crystallinity $X_c$ and the contact angle after the specific surface modification treatment is applied. The contact angle became significantly small when the crystallinity $X_c$ was 0.47 or less.

Preferably, the insulation layer may comprise the following configuration, for example. The insulation layer comprises polyethylene. The polyethylene has crystal structures of the triclinic crystal system or of the orthorhombic system, or of a coexisting state of at least one of these crystal structures. The polyethylene has preferential crystalline orientations in specific two or less number of crystal axes. A (100) crystalline orientation degree $O_{100}$ of the polyethylene expressed in the following Formula 2 is 0.26 or less. This insulation layer is hereinafter called a polyethylene insulation layer with specific orientation.

$$O_{100} = \frac{I_{200}}{I_{110} + I_{200}} \quad \text{[Formula 2]}$$

$I_{200}$ in Formula 2 is the X-ray diffraction intensity of the index 200, and $I_{110}$ is the X-ray diffraction intensity of the index 110.

The thickness of the plating layer can be made uniform easily when the insulation layer is the polyethylene insulation layer with specific orientation. Uniform thickness of the plating layer helps reduce the transmission loss of the signal transmission cable.

A method of obtaining the polyethylene insulation layer with specific orientation as the insulation layer may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid.

In any of the aforementioned treatments, the crystalline orientation degree $O_{100}$ can be decreased as the intensity of treatment is increased, and the crystalline orientation degree $O_{100}$ can be decreased as the duration of treatment is lengthened.

$I_{200}$ and $I_{110}$ in Formula 2 are calculated as follows.

Figure 10:
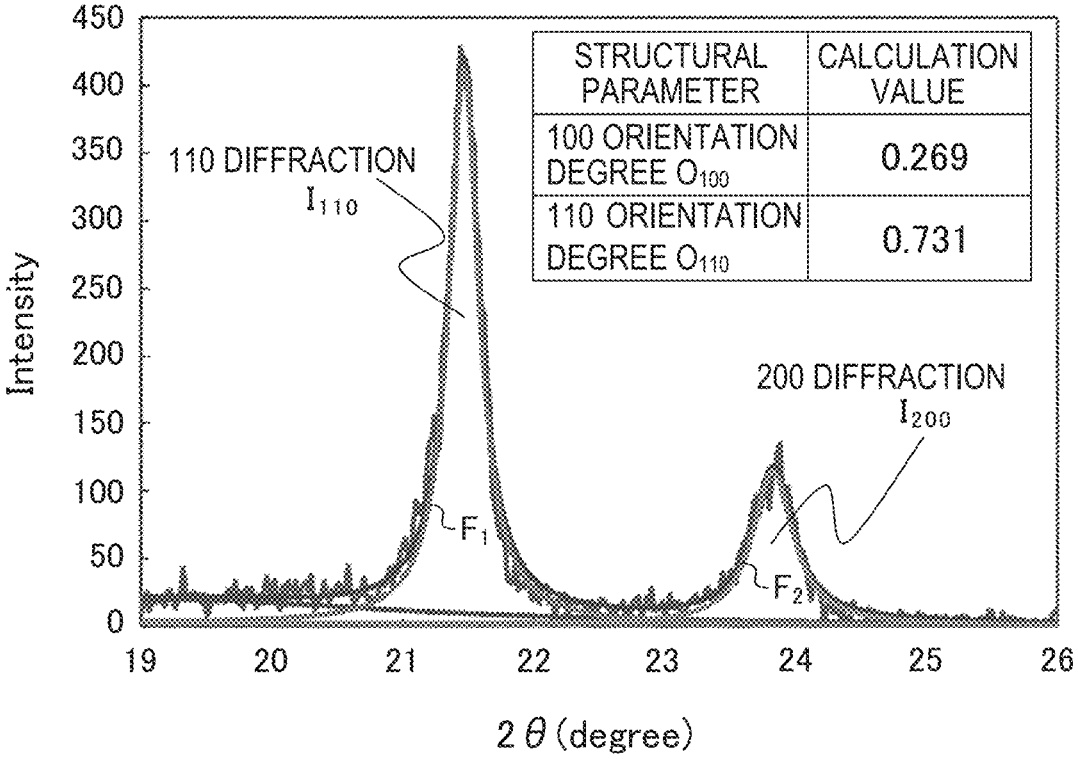
FIG. 10 is an X-ray diffraction pattern of an insulation layer specimen.
Figure 11:
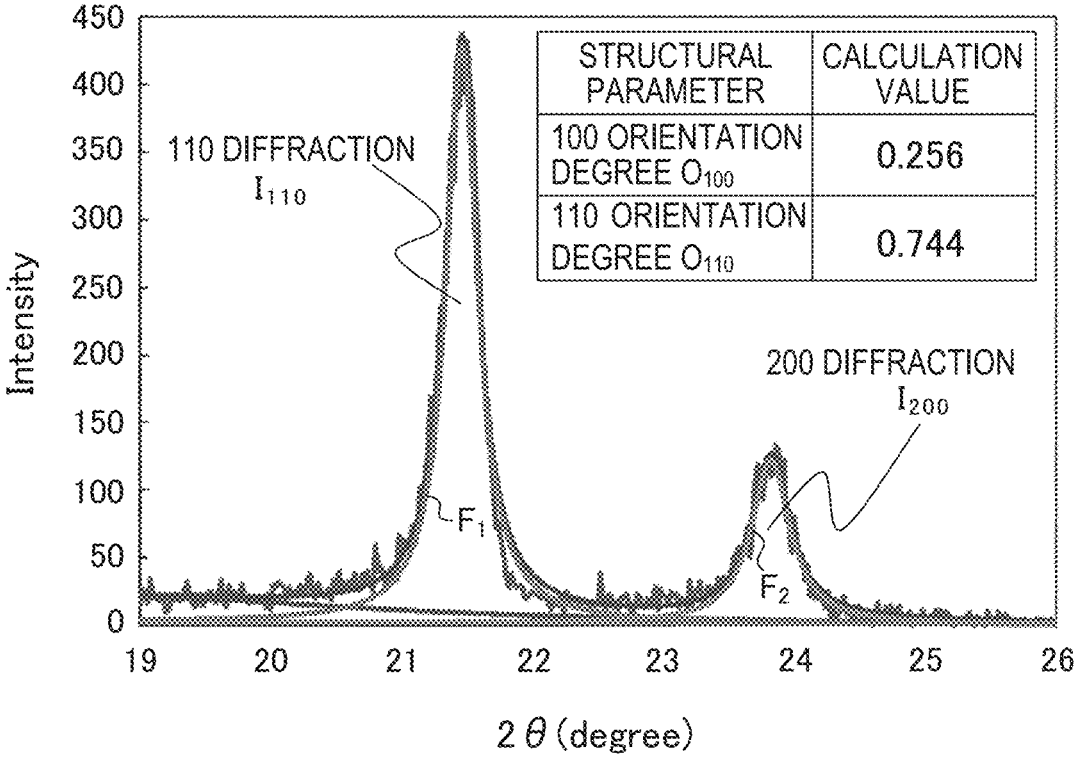
FIG. 11 is an X-ray diffraction pattern of an insulation layer specimen.

An X-ray diffraction pattern of an insulation layer specimen is obtained by using, for example, an X-ray diffraction apparatus RINT2500 by Rigaku Corporation. FIG. 10 and FIG. 11 show example X-ray diffraction patterns. In the X-ray diffraction patterns shown in FIG. 10 and FIG. 11, horizontal axes represent the diffraction angle 2θ. The range of the diffraction angle 2θ in the X-ray diffraction patterns is between 19° and 26° inclusive. FIG. 10 and FIG. 11 show the X-ray diffraction patterns of the polyethylene insulation layer specimens having a crystalline structure of the orthorhombic system. FIG. 10 shows an X-ray diffraction pattern of polyethylene with no surface modification treatment. FIG. 11 shows an X-ray diffraction pattern of polyethylene having undergone the corona discharge exposure process as the surface modification treatment.

Diffraction spectra having a peak around 21.5° (hereinafter called 110 diffraction spectra) correspond to the Miller index 110, which means the notation of crystallography for 110 plane in crystal lattice. Diffraction spectra having a peak around 23.8° (hereinafter called 200 diffraction spectra) corresponds to the Miller index 200, which means the notation of crystallography for 200 plane in crystal lattice.

Spectral fitting using the Lorentzian function is applied to the 110 diffraction spectra to obtain a smooth curve $F_1$ that satisfactorily matches the 110 diffraction spectra. The obtained curve $F_1$ is shown in FIG. 10 and FIG. 11. The intensity of the 110 diffraction spectra, obtained by the calculation of integrated intensity based on the curve $F_1$, will be denoted with $I_{110}$ hereafter.

Spectral fitting using the Lorentzian function is applied to the 200 diffraction spectra to obtain a smooth curve $F_2$ that satisfactorily matches the 200 diffraction spectra. The obtained curve $F_2$ is shown in FIG. 10 and FIG. 11. The intensity of the 200 diffraction spectra, obtained by the calculation of integrated intensity based on the curve $F_2$, will be denoted with $I_{200}$ hereafter.

If each crystal particle comprised in a material including a polycrystalline substance is preferentially oriented in a particular direction, then the X-ray diffraction intensity on a particular index plane is relatively high compared to the X-ray diffraction intensity on another index plane. Accordingly, orientation of a specific lattice plane can be quantified by a ratio of the X-ray diffraction intensity. The (100) crystal orientation degree $O_{100}$ is the ratio of the X-ray diffraction intensity and also shows preferential orientation of a (100) plane.

Figure 12:
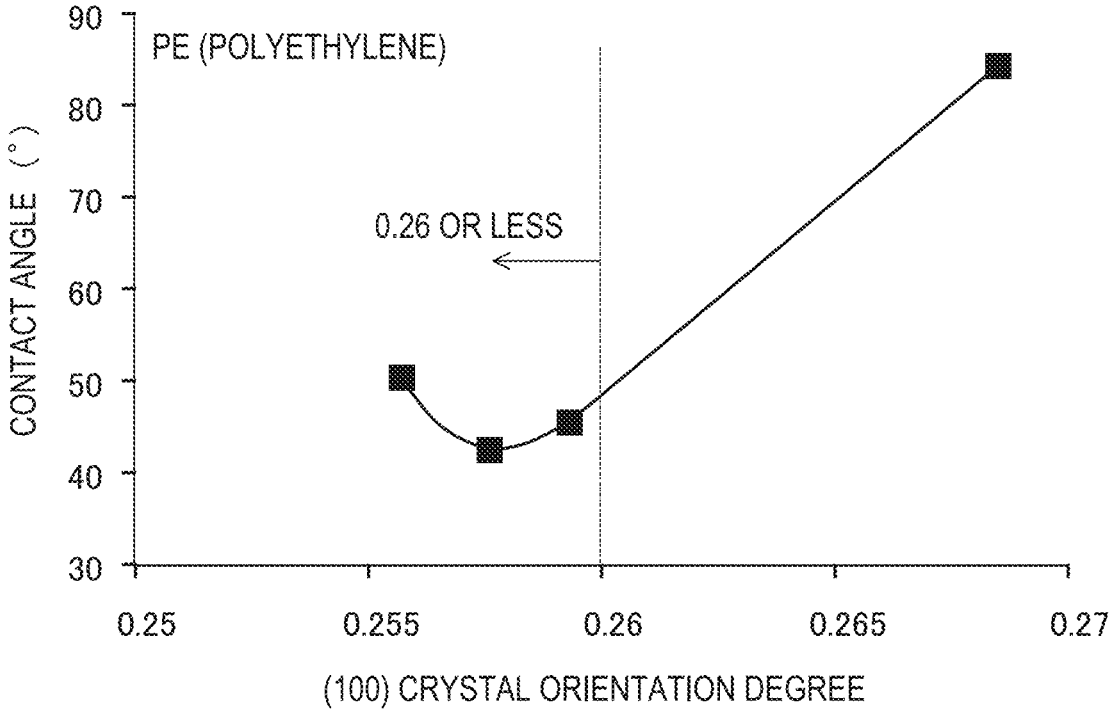
FIG. 12 is a graph showing a correlation between a (100) crystal orientation degree $O_{100}$ and a contact angle after specific surface modification treatment.

Through the following test, it was confirmed that there is a correlation between the (100) crystal orientation degree $O_{100}$ and the contact angle. The specific surface modification treatment was conducted on the polyethylene substrate. The substrate corresponds to the insulation layer. There are several conditions for the specific surface modification treatment. FIG. 12 shows the correlation between the (100) crystal orientation degree $O_{100}$ and the contact angle after the specific surface modification treatment is applied. The contact angle became significantly small when the (100) crystal orientation degree $O_{100}$ is 0.26 or less. The (100) crystal orientation degree $O_{100}$ is obtained before forming the plating layer.

Preferably, the insulation layer may comprise the following configuration, for example. The insulation layer is made of polyethylene. The polyethylene has a crystalline size of 18 nm or greater in the crystalline component. If the insulation layer is configured as mentioned above, the thickness of the plating layer can be easily made uniform. Uniform thickness of the plating layer can help reduce the transmission loss of the signal transmission cable.

A method of obtaining the aforementioned insulation layer may comprise the surface modification treatment, such as the electron beam irradiation, the ion irradiation, the corona discharge exposure, the plasma exposure, the ultraviolet irradiation, the X-ray irradiation, the γ-ray irradiation, and the immersion in ozone-containing liquid.

In any of the aforementioned treatments, the crystalline size of the polyethylene in the crystalline component can be increased as the intensity of treatment is increased, and the crystalline size of the polyethylene in the crystalline component can be increased as the duration of treatment is lengthened.

The crystalline size of the polyethylene in the crystalline component is expressed by the following Formula 4.

$$D = \frac{K\lambda}{B\cos\theta} \quad \text{[Formula 4]}$$

D in Formula 4 is the crystalline size of the polyethylene in the crystalline component. K is the Scherrer constant. The value of K is set to $2/\pi$. $\lambda$ is the X-ray wavelength. B is the spreading width of the X-ray diffraction peak. $\theta$ is the X-ray diffraction angle. $\lambda$, B, and $\theta$ are values that can be obtained from the X-ray diffraction pattern of an insulation layer specimen. The crystalline size is obtained before forming the plating layer.

Figure 13A:
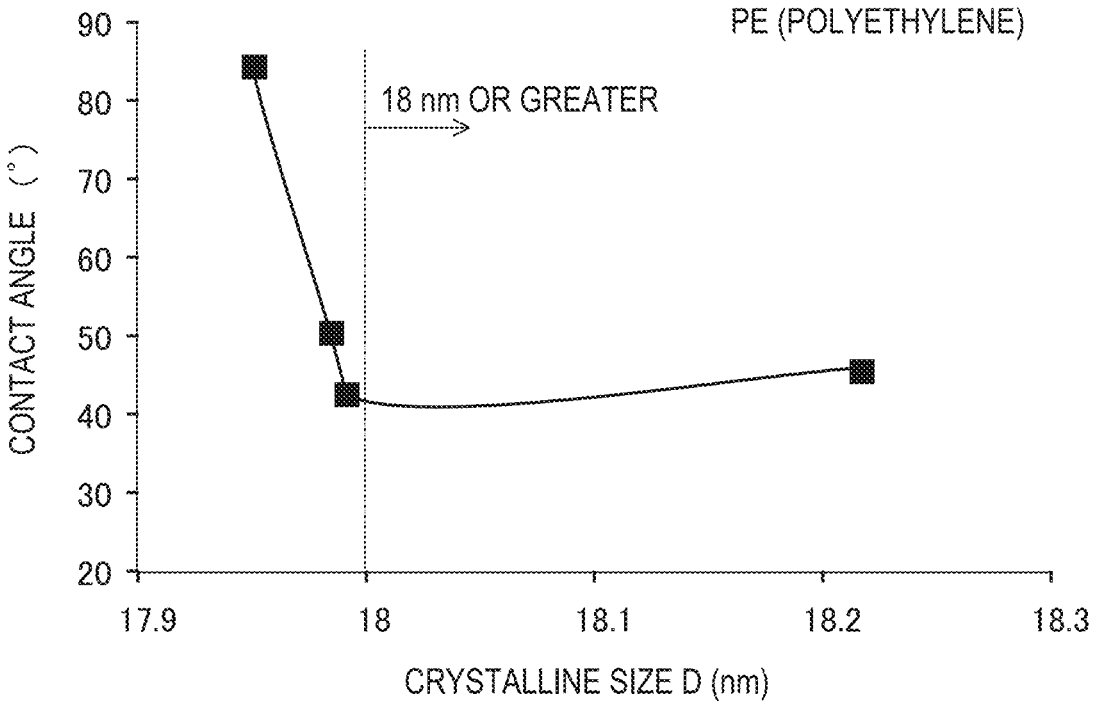
FIG. 13A is a graph showing a correlation between a crystalline size D and a contact angle of a crystalline component of polyethylene after specific surface modification treatment.

Through the following test, it was confirmed that there is a correlation between the crystalline size D of the polyethylene in the crystalline component and the contact angle. The specific surface modification treatment was conducted on the polyethylene substrate. The substrate corresponds to the insulation layer. There are several conditions for the specific surface modification treatment. FIG. 13A shows the correlation between the crystalline size D in the crystalline component of the polyethylene and the contact angle after the specific surface modification treatment is applied. The contact angle became significantly small when the crystalline size D in the crystalline component of the polyethylene was 18 nm or greater.

Preferably, the insulation layer may comprise the following configuration, for example. The insulation layer is made of FEP. The crystalline size in the crystalline component of FEP is 13.6 nm or less. If the insulation layer is configured as mentioned above, the thickness of the plating layer can be easily made uniform. Uniform thickness of the plating layer can help reduce the transmission loss of the signal transmission cable.

A method of obtaining the aforementioned insulation layer may comprise the surface modification treatment, such as the electron beam irradiation, the ion irradiation, the corona discharge exposure, the plasma exposure, the ultraviolet irradiation, the X-ray irradiation, the $\gamma$-ray irradiation, and the immersion in ozone-containing liquid.

In any of the aforementioned treatments, the crystalline size in the crystalline component of FEP can be increased as the intensity of treatment is increased, and the crystalline size in the crystalline component of FEP can be increased as the duration of treatment is lengthened. A method of calculating the crystalline size in the crystalline component of FEP is the same as the method of calculating the crystalline size in the crystalline component of the polyethylene. The crystalline size is obtained before forming the plating layer.

Figure 13B:
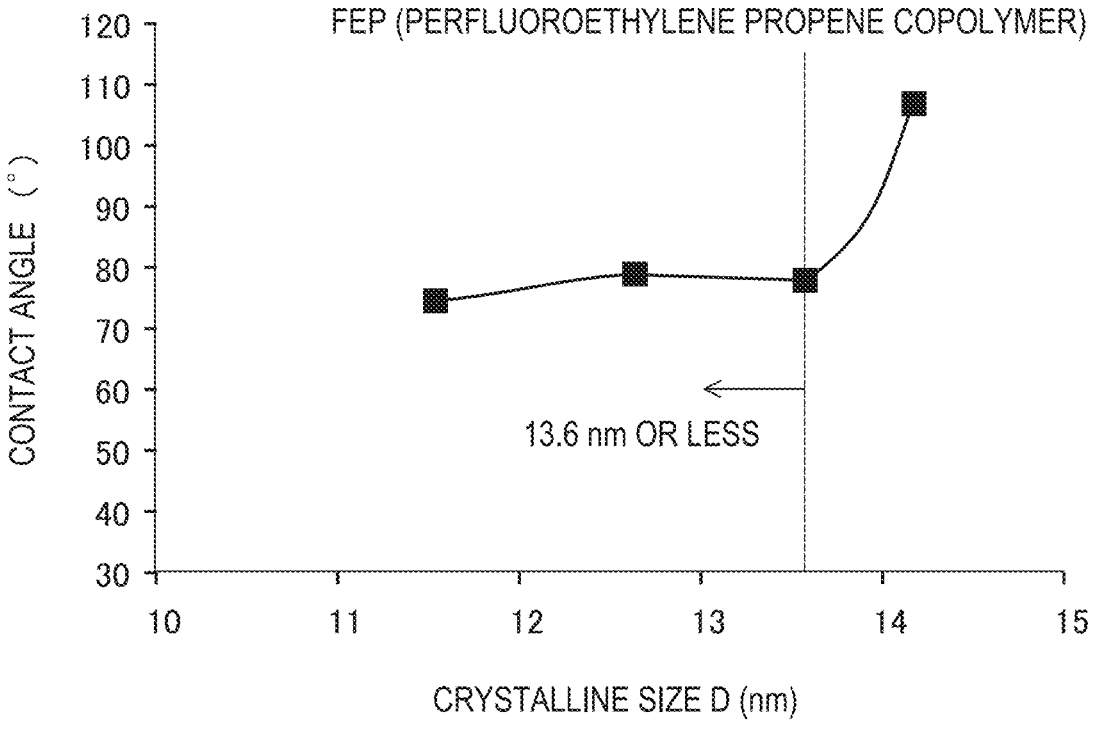
FIG. 13B is a graph showing a correlation between a crystalline size D and a contact angle of a crystalline component of perfluoroethylene-propene copolymer after specific surface modification treatment.

There is a correlation between the crystalline size D in the crystalline component of FEP and the contact angle. This was confirmed by the following test. The specific surface modification treatment was conducted on the FEP substrate. The substrate corresponds to the insulation layer. There are several conditions for the specific surface modification treatment. FIG. 13B shows the correlation between the crystalline size D in the crystalline component of FEP and the contact angle after the specific surface modification treatment is applied. The contact angle became significantly small when the crystalline size D in the crystalline component of FEP was 13.6 nm or less.

(1-3) Plating Layer

Preferably, the thickness of the plating layer may be between 1 μm and 5 μm inclusive. The shielding effect by the plating layer is significantly high when the thickness of the plating layer is 1 μm or greater. With such a thickness, an intra-pair skew can be decreased further and the differential-to-common mode conversion energy can be reduced further in the case where the signal transmission cable in the present disclosure is the differential signal transmission cable. The differential-to-common mode conversion energy can be particularly significantly reduced in a case of transmitting a signal of 25 GHz or higher.

Time required to form the plating layer can be shortened when the thickness of the plating layer is 5 μm or less. Flexibility of the signal transmission cable can be improved when the thickness of the plating layer is 5 μm or less. An outer diameter of the signal transmission cable can be small when the thickness of the plating layer is 5 μm or less. The thickness of the plating layer can be controlled by a publicly known method. For example, the plating layer can be made thicker as the time for electroplating and/or electroless-plating is lengthened. The plating layer can be made thicker as the current for the electroplating is increased.

Preferably, a standard deviation of the thickness of the plating layer may be 0.8 μm or less. This can reduce the transmission loss of the signal transmission cable, and also reduce noise further since extraordinally thin portion of the plating layer is hardly produced.

The standard deviation of the thickness of the plating layer may be calculated by the following method. Four cross-sections are taken at four positions on the differential signal transmission cable. Each cross-section is taken orthogonally to the longitudinal direction of the differential signal transmission cable. The distance between the adjacent cross-sections is 3 m. Four points are randomly selected on each of the four cross-sections, providing sixteen points in total for measuring the thickness of the plating layer. A standard deviation of all the measured thicknesses at the sixteen points is used as the standard deviation of the thickness of the plating layer.

For example, the standard deviation of the thickness of the plating layer can be reduced by decreasing the contact angle on the outer peripheral surface of the insulation layer or by increasing the absolute value of the adhesion-wetting surface free energy.

The contact angle on the outer peripheral surface of the insulation layer can be decreased and the absolute value of the adhesion-wetting surface free energy can be increased by conducting the surface modification treatment on the insulation layer. The surface modification treatment may be, for example, the electron beam irradiation, the ion irradiation, the corona discharge exposure, the plasma exposure, the ultraviolet irradiation, the X-ray irradiation, the $\gamma$-ray irradiation, and the immersion in ozone-containing liquid.

The plating layer may comprise stacked layers. The number of the stacked layers may be 2, 3, or 4 or more. A part of the stacked layers may be a magnetic layer comprising ferrite, for example, and another part of the stacked layers may be a nonmagnetic layer comprising copper, for example. This enables the plating layer to exert the shielding effect against ferromagnetic fields and weak magnetic fields. The plating layer can exert the shielding effect against noise in a low frequency band in a range from several tens of MHz to several hundreds of MHz, and also against noise in a high frequency band of several tens of GHz.

The plating layer may be formed, for example, through the electroless-plating process followed by the electroplating process. The plating layer can be easily formed on the insulation layer by this method. The method also requires less time to form the plating layer than a method of forming the entire plating layer by the electroless-plating process.

2. METHOD OF MANUFACTURING SIGNAL TRANSMISSION CABLE

The signal transmission cable in the present disclosure can be manufactured by the following method, for example.

Figure 14:
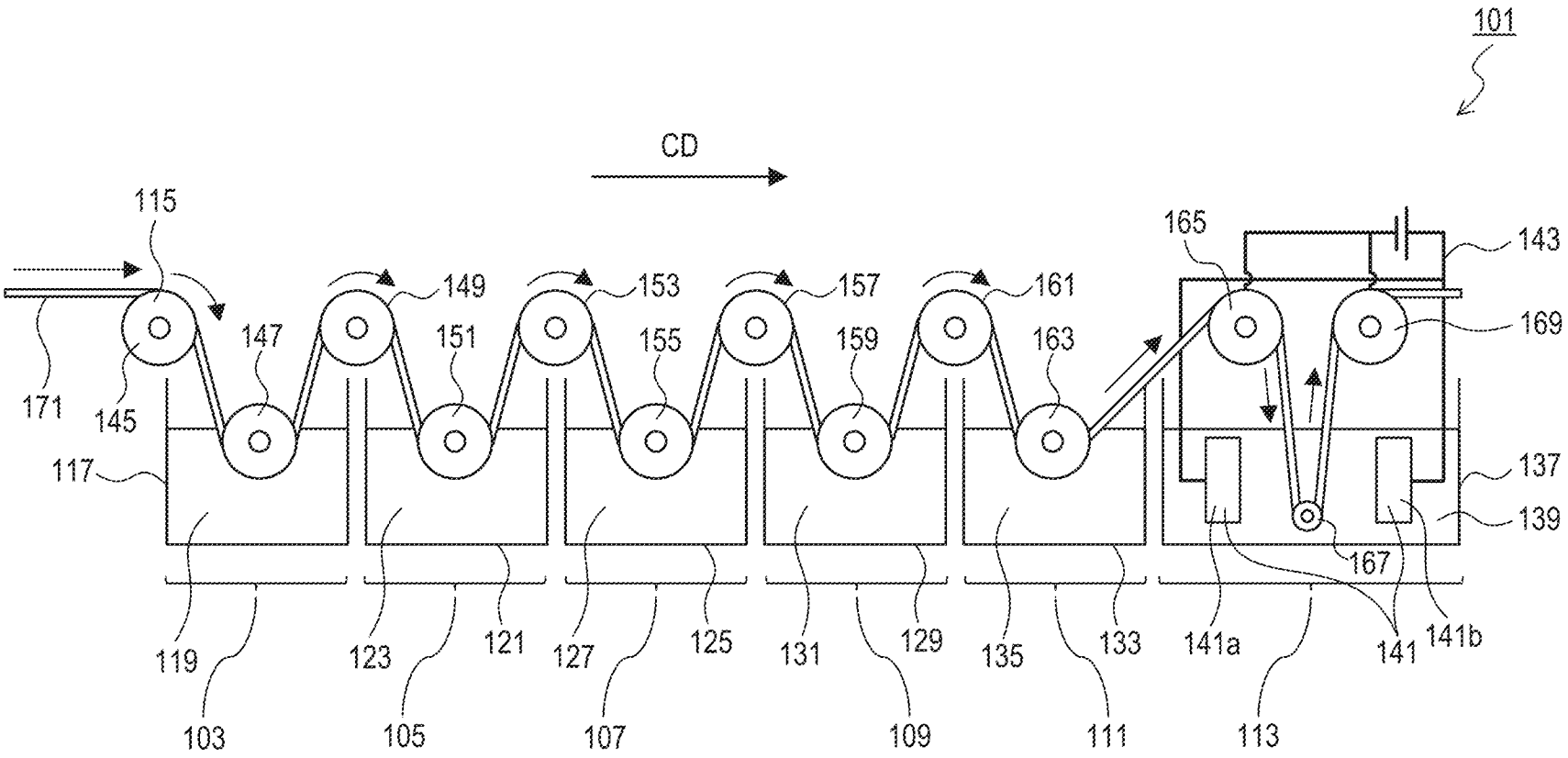
FIG. 14 is an explanatory diagram showing a configuration of a manufacturing system 101.

FIG. 14 shows a manufacturing system 101 used to manufacture the differential signal transmission cable. The differential signal transmission cable corresponds to the signal transmission cable. The manufacturing system 101 comprises a degreasing unit 103, a wet etching unit 105, a first activation unit 107, a second activation unit 109, an electroless-plating unit 111, an electroplating unit 113, and a conveyer unit 115.

The degreasing unit 103 comprises a degreasing bath 117, and a degreaser 119. The degreaser 119 is contained in the degreasing bath 117. The degreaser 119 comprises at least one of sodium borate, sodium phosphate or surfactant, for example. The temperature of the degreaser 119 is in a range, for example, from 40° C. to 60° C.

The wet etching unit 105 for the surface roughening treatment comprises an etching bath 121 and an etching solution 123. The etching solution 123 is contained in the etching bath 121. The etching solution 123 comprises at least one of chromic acid, sulfuric acid, ozone, acid, alkali or chelate, for example. The temperature of the etching solution 123 is in a range, for example, from 65° C. to 70° C.

The first activation unit 107 comprises a first activation bath 125 and a first liquid activator 127. The first liquid activator 127 is contained in the first activation bath 125. The first liquid activator 127 comprises at least one of palladium chloride, tin (II) chloride, or concentrated hydrochloric acid, for example. The temperature of the first liquid activator 127 is in a range, for example, from 30° C. to 40° C.

The second activation unit 109 comprises a second activation bath 129 and a second liquid activator 131. The second liquid activator 131 is contained in the second activation bath 129. The second liquid activator 131 comprises sulfuric acid, for example. The temperature of the second liquid activator 131 is in a range, for example, from 0° C. to 50° C.

The electroless-plating unit 111 comprises an electroless-plating bath 133 and an electroless-plating liquid 135. The electroless-plating liquid 135 is contained in the electroless-plating bath 133. The electroless-plating liquid 135 comprises, for example, copper sulfate, Rochelle salt, formaldehyde, and sodium hydroxide. The temperature of the electroless-plating liquid 135 is in a range, for example, from 20° C. to 30° C.

The electroplating unit 113 comprises an electroplating bath 137, an electroplating liquid 139, anodes 141, and a power source unit 143. The anodes 141 comprise a first anode 141*a* and a second anode 141*b*. The electroplating liquid 139 is contained in the electroplating bath 137. The electroplating liquid 139 comprises a composition as shown in Table 1 or Table 2, for example. The temperature of the electroplating liquid 139 is in a range, for example, from 20° C. to 25° C.

TABLE 1

Composition of Copper Sulfate Plating Bath

| Composition of Plating Bath | Chemical Formula | Concentration (g/l) |
|---|---|---|
| Copper sulfate | $CuSO_4 \cdot 5H_2O$ | 60~250 |
| Metallic copper | Cu | 15~70 |
| Sulfuric acid | $H_2SO_4$ | 25~220 |

TABLE 1-continued

Composition of Copper Sulfate Plating Bath

| Composition of Plating Bath | Chemical Formula | Concentration (g/l) |
|---|---|---|
| Chloride ion (Sodium chloride, Hydrochloric acid*) | $Cl^-$ (NaCl, HCl) | 0.02~0.2 |

TABLE 2

Composition of Copper Cyanide Plating Bath

| Composition of Plating Bath | Chemical Formula | Concentration (g/l) |
|---|---|---|
| Copper(I) cyanide | CuCN | 20~80 |
| Sodium cyanide (Potassium cyanide) | NaCN (KCN) | 25~130 |
| Free sodium cyanide* (Free potassium cyanide) | NaCN (KCN) | 5~25 |
| Pottasium sodium tartrate | $KNaC_4H_4O_6 \cdot 4H_2O$ | 15~60 |
| Sodium carbonate (Pottasium carbonate) | $Na_2CO_3$ ($K_2CO_3$) | 10~30 |
| Pottasium hydroxide (Sodium hydroxide) | KOH (NaOH) | 10~20 |

The anodes 141 are immersed in the electroplating liquid 139. The anodes 141 are produced by, for example, casting and roll-forging of molten copper produced from copper melt. Alternatively, the anodes 141 may be produced by the following method. Starting-sheet electrolysis is performed using a crude copper as an anode and a stainless-steel or titanium as a cathode. Pure copper plates deposited on the surface of the cathode are removed and used as the anodes 141. The power source unit 143 applies a direct current voltage between the anodes 141 and bobbins 165 and 169, which will be explained later.

The conveyer unit 115 comprises bobbins 145, 147, 149, 151, 153, 155, 157, 159, 161, 163, 165, 167, and 169. Hereinafter, these bobbins may also be referred to as bobbins collectively. The bobbins 165 and 169 are electrically conductive. The bobbin 167 has an insulating property.

As shown in FIG. 14, the bobbins are basically arranged in series along a conveying direction CD. The conveying direction CD is the direction from the degreasing unit 103 toward the electroplating unit 113 via the wet etching unit 105, the first activation unit 107, the second activation unit 109, and the electroless-plating unit 111 in this order.

A part of the bobbin 147 is immersed in the degreaser 119. A part of the bobbin 151 is immersed in the etching solution 123. Apart of the bobbin 155 is immersed in the first liquid activator 127. A part of the bobbin 159 is immersed in the second liquid activator 131. A part of the bobbin 163 is immersed in the electroless-plating liquid 135. The bobbin 167 is entirely immersed in the electroplating liquid 139.

The conveyer unit 115 continuously conveys the differential signal transmission cable 171 through the bobbins in the conveying direction CD. The differential signal transmission cable 171 has the signal line(s) and the insulation layer in an initial state, but the plating layer is not yet formed. The insulation layer may be prepared by, for example, a publicly known extrusion molding.

In the conveyance, the differential signal transmission cable 171 is first immersed in the degreaser 119 in the degreasing unit 103 for 3 to 5 minutes. Thus, grease smeared on the surface of the insulation layer is removed.

The differential signal transmission cable 171 is then immersed in the etching solution 123 in the wet etching unit 105 for 8 to 15 minutes. Thus, irregularities are formed on the outer peripheral surface of the insulation layer. Also, functional groups, such as a carbonyl group and a hydroxy group, are formed on the outer peripheral surface of the insulation layer. Consequently, the outer peripheral surface of the insulation layer is hydrophilized, which improves the surface wettability.

The differential signal transmission cable 171 is then immersed in the first liquid activator 127 in the first activation unit 107 for 1 to 3 minutes. Thus, a catalytic layer is formed on the outer peripheral surface of the insulation layer.

The differential signal transmission cable 171 is then immersed in the second liquid activator 131 in the second activation unit 109 for 3 to 6 minutes. Thus, a surface of the catalytic layer is cleaned.

The differential signal transmission cable 171 is then immersed in the electroless-plating liquid 135 in the electroless-plating unit 111. An immersion time is, for example, 10 minutes or shorter. An electroless-plating layer is thus formed on the outer peripheral surface of the insulation layer. The electroless-plating layer corresponds to the plating layer. The electroless-plating layer becomes thicker as the immersion time in the electroless-plating liquid 135 lengthens.

The differential signal transmission cable 171 is then immersed in the electroplating liquid 139 in the electroplating unit 113. An immersion time is, for example, 3 minutes or shorter. An electroplating layer is thus formed on the outer peripheral surface of the electroless-plating layer. The electroplating layer corresponds to the plating layer. The electroplating layer becomes thicker as the immersion time in the electroplating liquid 139 lengthens. Table 3 shows specific conditions for the electroplating in the electroplating unit 113.

Manufacture of the differential signal transmission cable 171 is completed through the aforementioned steps.

TABLE 3

Conditions for Electroplating by Copper Sulfate Plating Bath

| Items | Control Value |
|---|---|
| Bath temperature (° C.) | 20~25 |
| Cathode current density ($A/dm^2$) | 1~6 |
| Anode current density ($A/dm^2$) | ~2.5 |
| Bath voltage (V) | 1~6 |
| Agitation method | Air agitation |
| Filteration | Continuous filteration, at least 3 times/hour |
| Anode | Phosphorized copper |
| Anode bag | Saran ® fiber, etc. |

Although it is omitted in FIG. 14, the differential signal transmission cable 171 is cleaned in pure water between the units. A method of cleaning may include ultrasonic cleaning, oscillation cleaning, and running water cleaning. The cleaning with pure water helps reduce residues of agents used in a previous unit being brought into a subsequent unit.

Conveying speed of the differential signal transmission cable 171 may be appropriately adjusted. The conveying speed may be changed during the conveyance, or the conveyance may be suspended.

Figure 15:
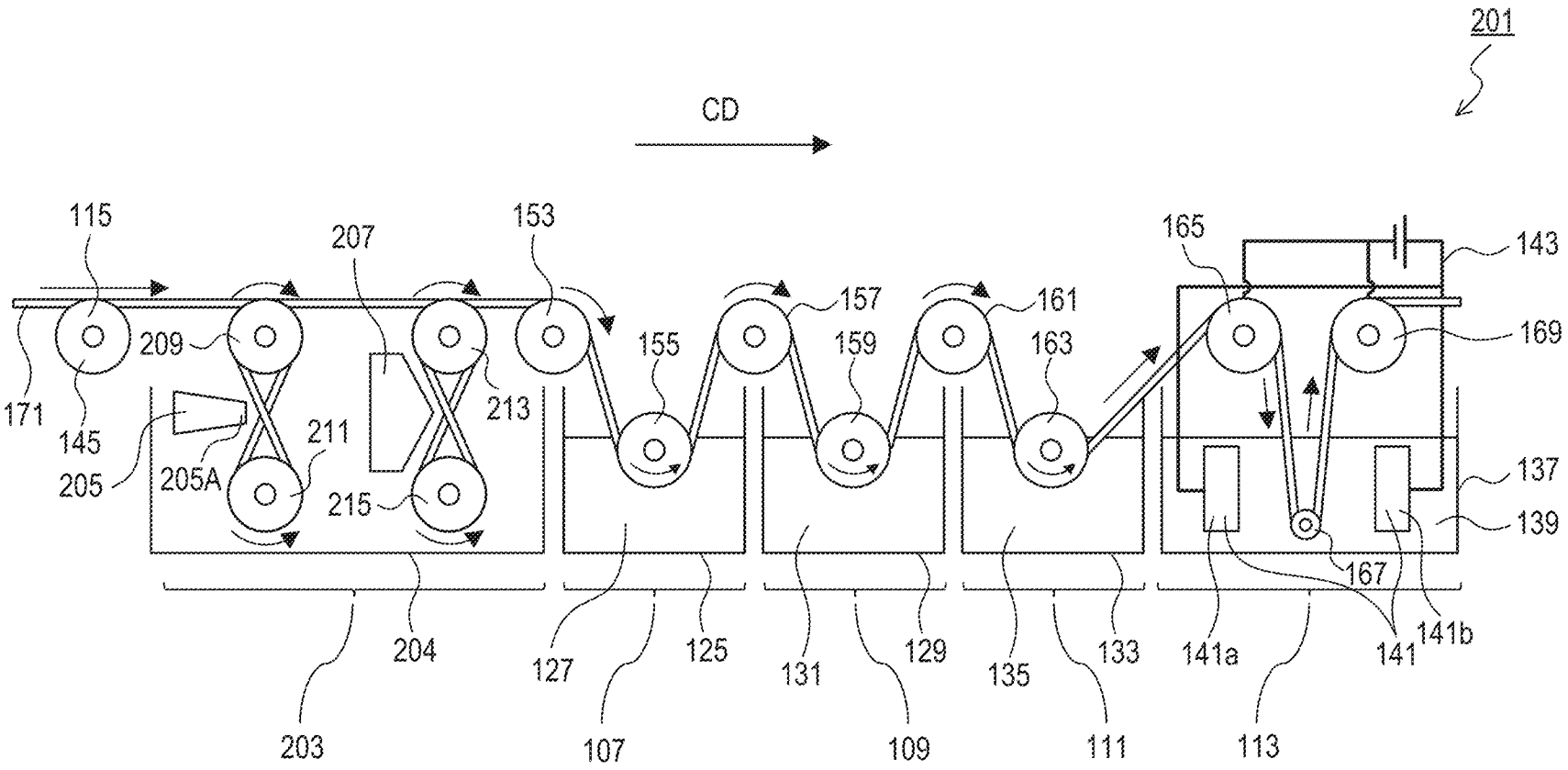
FIG. 15 is an explanatory diagram showing a configuration of a manufacturing system 201.
Figure 16:
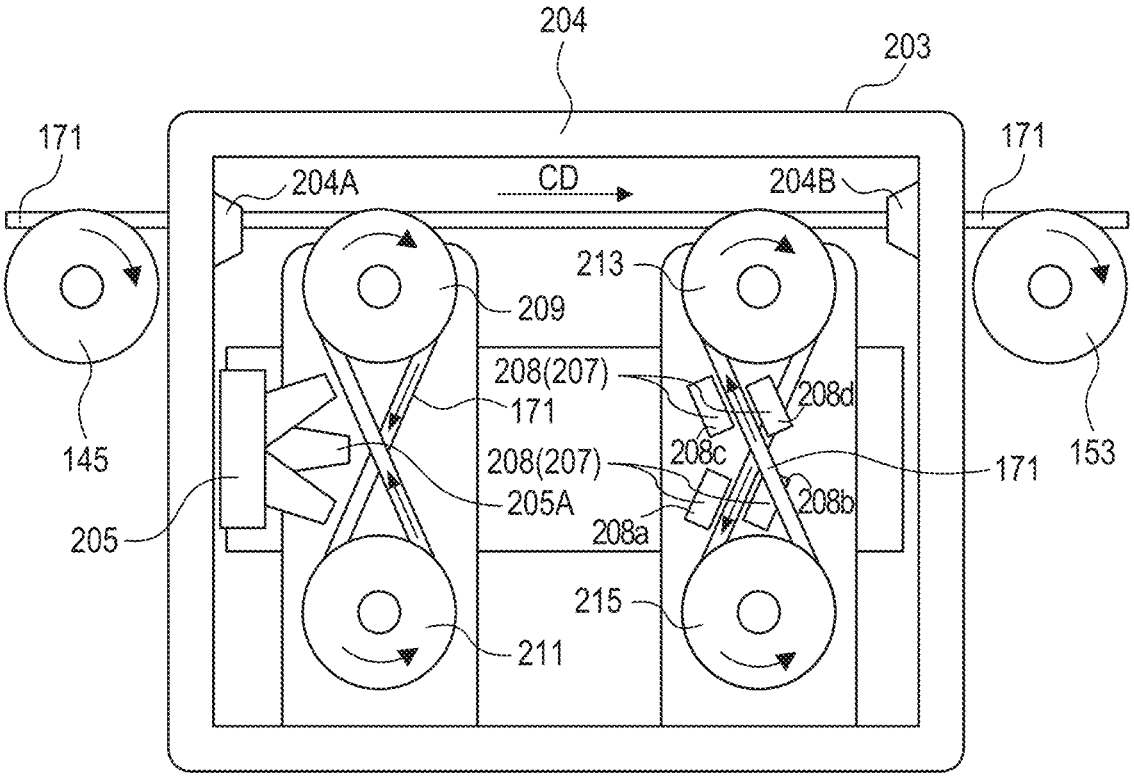
FIG. 16 is an explanatory diagram showing a configuration of a surface improving unit 203.

The differential signal transmission cable may be manufactured by using a manufacturing system 201 shown in FIG. 15. The structure of the manufacturing system 201 is basically the same as the manufacturing system 101, but is partially different from the manufactruing system 101. In the explanations hereinafter, such differences will be focused. The manufacturing system 201 comprises a surface improving unit 203 but no degreasing unit 103 or wet etching unit 105. FIG. 16 shows a detailed configuration of the surface improving unit 203.

The surface improving unit 203 comprises a housing 204, a fine-shape forming device 205, and a hydrophilic treatment device 207. The housing 204 houses components of the surface improving unit 203. Along the conveying direction CD, the housing 204 comprises an inlet 204A in its upstream end, and an outlet 204B in its downstream end.

The conveyer unit 115 comprises, in the housing 204, four bobbins 209, 211, 213, and 215. The bobbin 145 guides the differential signal transmission cable 171 into the housing 204 through the inlet 204A. The differential signal transmission cable 171, guided into the housing 204, is then conveyed through a figure-eight path from the bobbin 209 to the bobbin 211 and returns to the bobbin 209. The differential signal transmission cable 171 is then conveyed from the bobbin 209 to the bobbin 213, then conveyed through another figure-eight path from the bobbin 213 to the bobbin 215, and returns to the bobbin 213. The differential signal transmission cable 171 is then guided to exit from the outlet 204B to the bobbin 153 and conveyed to the first activation unit 107.

The fine-shape forming device 205 blasts fine particles of dry ice from a nozzle 205A against the differential signal transmission cable 171 that is situated between the bobbin 209 and the bobbin 211. The blast is driven by an air pressure. The arithmetic average roughness Ra of the outer peripheral surface of the insulation layer increases due to the collision with the fine particles of dry ice. The fine-shape forming device 205 performs the dry-ice-blasting accordingly. The dry-ice-blasting corresponds to the surface roughening treatment.

The outer peripheral surface of the insulation layer turns its first side to the nozzle 205A when conveyed from the bobbin 209 to the bobbin 211 and turns its second side to the nozzle 205A when returned from the bobbin 211 to the bobbin 209. Accordingly, the fine-shape forming device 205 can help increase the arithmetic average roughness Ra across the entire area of the outer peripheral surface of the insulation layer.

Particle diameters of the fine particles of dry ice, a distance between the tip of the nozzle 205A and the differential signal transmission cable 171, and other particulars can be appropriately determined. A temperature of the differential signal transmission cable 171 is, for example, 20° C.

Conditions of the dry-ice-blasting may be appropriately changed. The conditions may comprise, for example, the particle diameters of the fine particles of dry ice, a flow amount of the dry ice, the air pressure, the distance between the tip of the nozzle 205A and the differential signal transmission cable 171, the conveying speed of the differential signal transmission cable 171, and the temperature of the differential signal transmission cable 171. For example, the dry-ice-blasting may be conducted at a temperature lower than a glass transition temperature of a material of the insulation layer. Such a temperature may be, for example, between −79° C. and 20° C. inclusive. The position of the nozzle 205A may be fixed, may oscillate, or may scan.

The hydrophilic treatment device 207 performs hydrophilic treatment by the corona discharge exposure. The corona discharge exposure process corresponds to the surface modification treatment. As shown in FIG. 16, the hydrophilic treatment device 207 comprises four plate electrodes 208 (first to fourth plate electrodes 208*a*, 208*b*, 208*c*, and 208*d*). The first and second plate electrodes 208*a* and 208*b* face each other across the differential signal transmission cable 171 that is conveyed from the bobbin 213 to the bobbin 215. The third and fourth plate electrodes 208*c* and 208*d* face each other across the differential signal transmission cable 171 that returns from the bobbin 215 to the bobbin 213. Corona discharge is generated by applying a high-frequency high voltage between the facing plate electrodes 208. Exposure to the corona discharge hydrophilizes the outer peripheral surface of the insulation layer and improves the wettability. Improved wettability decreases the contact angle and increases the absolute value of the adhesion-wetting surface free energy.

A mechanism that the corona discharge exposure hydrophilizes the outer peripheral surface of the insulation layer and improves the wettability is assumed as below. High energy electrons generated by the corona discharge exposure ionize and/or dissociate oxygen molecules in the air and produce oxygen radical, ozone, and so forth. Simultaneously, the high energy electrons that reach close proximity of the outer peripheral surface of the insulation layer cut and cleave main chains and side chains of, for example, polyethylene and FEP comprised in the insulation layer. The aforementioned oxygen radical, ozone, and so forth generated by the corona discharge are recombined with these cleaved main chains and side chains to form polar functional groups, such as the hydroxy group and the carbonyl group, on the outer peripheral surface of the insulation layer. As a result, the outer peripheral surface of the insulation layer is hydrophilized and its wettability is improved.

For example, the voltage applied in the corona discharge exposure process is in a range from 2 to 14 kV, and the frequency is 15 kHz. The distance between the outer peripheral surface of the insulation layer and each of the plate electrodes 208 is, for example, between 0.1 mm and 3 mm inclusive. The ambience inside the housing 204 is, for example, the atmospheric air.

The conditions of the corona discharge exposure may be appropriately changed. The conditions may comprise, for example, a magnitude of the applied voltage, a frequency of the applied voltage, a distance between the outer peripheral surface of the insulation layer and each of the plate electrodes 208, and the ambience inside the housing 204. The ambience inside the housing 204 may include oxygen, nitrogen, carbon dioxide, and a rare gas. A material such as a silicone rubber may be interposed between the outer peripheral surface of the insulation layer and each of the plate electrodes 208. In this case, each of the plate electrodes 208 contacts the insulation layer indirectly and slides against the silicone rubber during the corona discharge.

In addition, an exhaust ventilation system to discharge the air inside the housing 204 and/or a dryer to dry an inside space of the housing 204 may be arranged. This helps reduce rust of the differential signal transmission cable 171. A neutralization apparatus may also be arranged in the housing 204. This helps reduce static electricity in the housing 204.

As mentioned above, the method of manufacturing the differential signal transmission cable using the manufacturing system 201 begins with the dry-ice-blasting on the outer peripheral surface of the insulation layer, followed by the corona discharge exposure process on the outer peripheral surface of the insulation layer, and then a permanganate treatment. Then, after the permanganate treatment, the plating layer is formed on the outer peripheral surface of the insulation layer. The dry-ice-blasting corresponds to the surface roughening treatment. The corona discharge exposure process corresponds to the surface modification treatment. The permanganate treatment facilitates plating on the insulation layer. The permanganate treatment also improves a transmission property of the differential signal transmission cable. The permanganate treatment may be conducted after the surface roughening treatment, and the corona discharge exposure process may be conducted thereafter.

Figure 17:
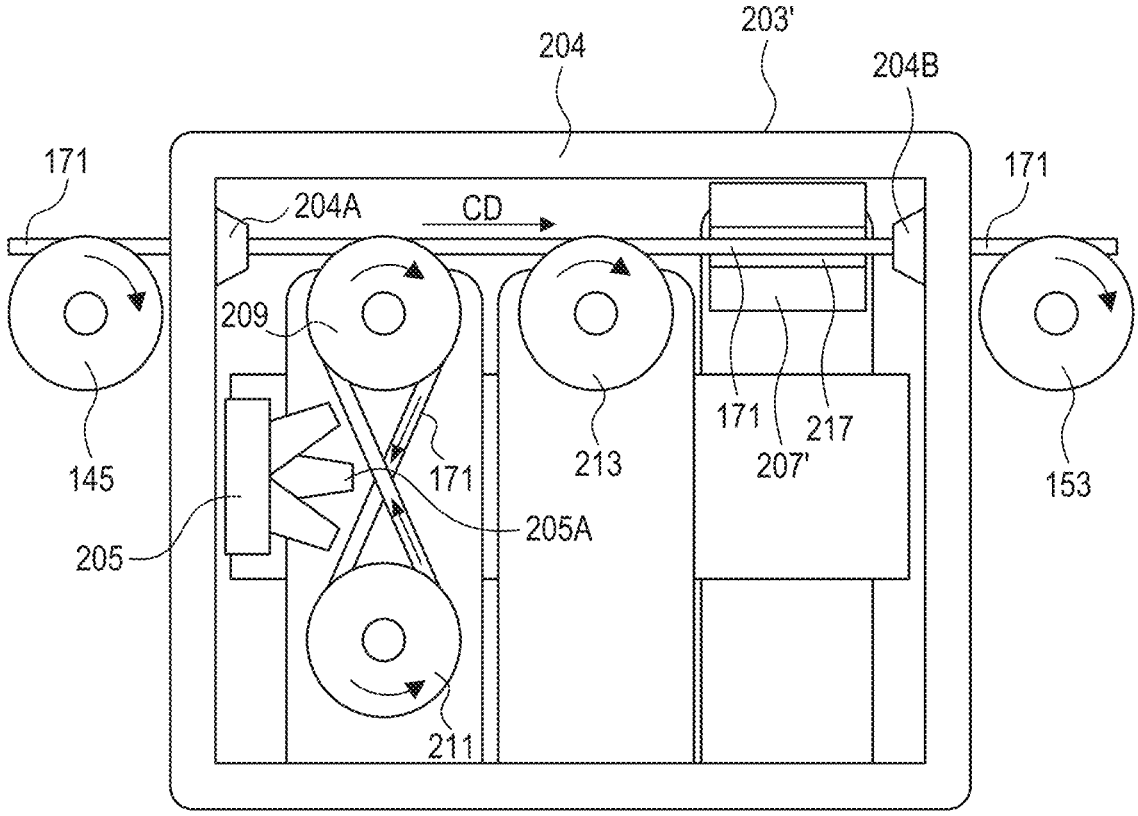
FIG. 17 is an explanatory diagram showing a configuration of the surface improving unit 203'.

The surface improving unit 203 may be configured as a surface improving unit 203' shown in FIG. 17. This surface improving unit 203' comprises a hydrophilic treatment device 207' in a cylindrical shape. The hydrophilic treatment device 207' comprises a shaft hole 217. The differential signal transmission cable 171 conveyed by the bobbins 209, 213 passes through the shaft hole 217. The hydrophilic treatment device 207' generates the corona discharge inside the shaft hole 217. An exposure to the corona discharge causes hydrophilization of the outer peripheral surface of the insulation layer and improves the wettability. This decreases the contact angle and increases the absolute value of the adhesion-wetting surface free energy. The corona discharge exposure process corresponds to the surface modification treatment.

Figure 18:
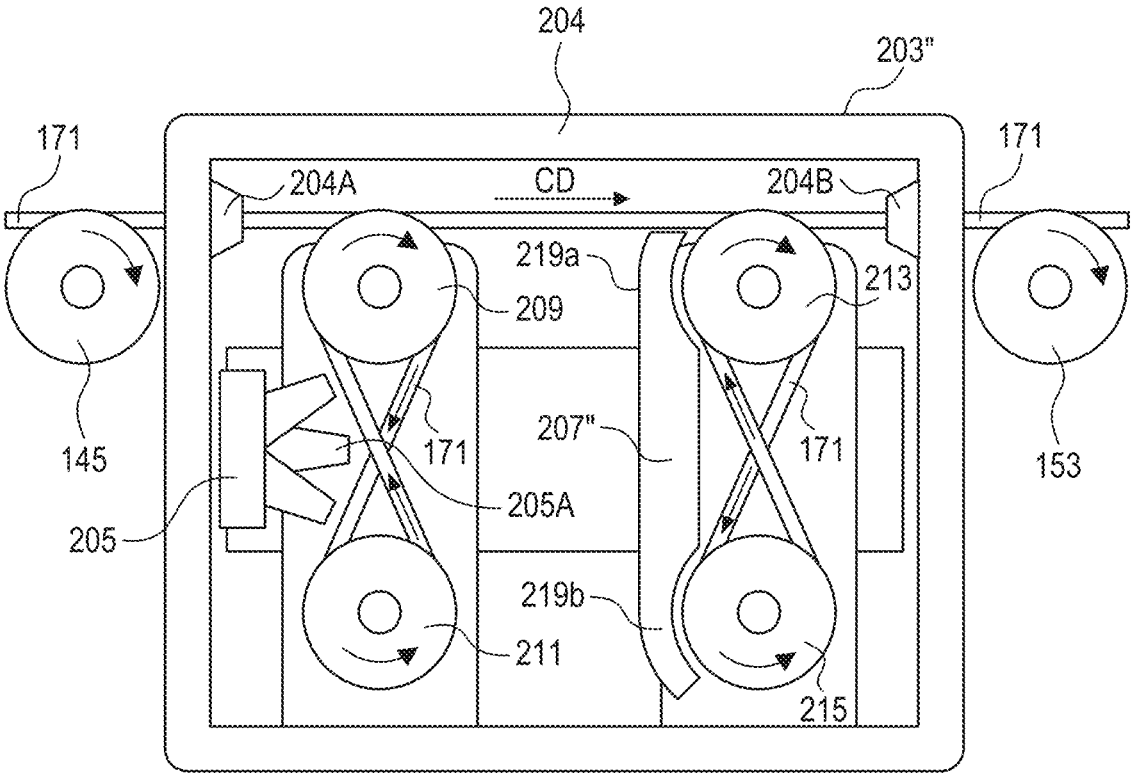
FIG. 18 is an explanatory diagram showing a configuration of the surface improving unit 203"

The surface improving unit 203 may be configured as a surface improving unit 203" shown in FIG. 18. A hydrophilic treatment device 207" of the surface improving unit 203" comprises an arc-shaped first electrode 219*a* that faces the bobbin 213, and an arc-shaped second electrode 219*b* that faces the bobbin 215. The bobbins 213 and 215 are grounded to the earth. The hydrophilic treatment device 207" generates the corona discharge by applying a voltage between the first electrode 219*a* and the bobbin 213, and between the second electrode 219*b* and the bobbin 215. Exposure to the corona discharge hydrophilizes the outer peripheral surface of the insulation layer and improves its wettability. This decreases the contact angle and increases the absolute value of the adhesion-wetting surface free energy. The corona discharge exposure process corresponds to the surface modification treatment.

Signal transmission cables other than the differential signal transmission cable can be manufactured by methods similar to the methods as mentioned above.

3. MULTICORE CABLE

A multicore cable in the present disclosure comprises signal transmission cables, a conductor layer, and a jacket. The conductor layer is configured to cover the signal transmission cables collectively. The jacket is configured to cover the conductor layer. Each of the signal transmission cables has basically the same structure as the signal transmission cable explained in the aforementioned section of "1. Signal Transmission Cable" and further comprises an outer insulation layer that is configured to cover the plating layer.

The signal transmission cables may be twisted or may not be twisted. The number of the signal transmission cables is not particularly limited and may be two, eight, or twenty-four, for example. For example, the signal transmission cables may be divided into two or more groups, and an interposition may be placed between the groups. Each group comprises, for example, two or more signal transmission cables. Each signal transmission cable may be a differential signal transmission cable that comprises two signal lines or may be other type of signal transmission cable.

The conductor layer may be constituted by, for example, a shield tape conductor, and a braided wire. The conductor layer may comprise, for example, stacked layers of the shield tape conductor and the braided wire. Materials generally used for manufacturing cables can be used as materials for the shield tape conductor and the braided wire. Likewise, materials generally used for cables can also be used as materials for the jacket.

An outer insulating layer may be, for example, an insulating tape, a laminating tape, a film with spray-applied insulator or the like. The laminating tapes such as those generally used for flat cables may be used, for example. The outer insulating layers should be preferably formable at room temperature or at low temperature. This can reduce deformation of the insulation layer due to heat when forming the outer insulating layer.

A material for the interposition may comprise, for example, a paper, a thread, a foamed body and the like. Examples of the foamed body may comprise polyolefin foams, such as a polypropylene foam and an ethylene foam. The arithmetic average roughness Ra of the outer peripheral surface of the insulation layer is 0.6 μm or greater in the signal transmission cables of the multicore cable in the present disclosure. This results in high adhesion between the insulation layer and the plating layer, which then reduces occurrence of a gap between the insulation layer and the plating layer. As a consequence, a high shielding effect by the plating layer is provided. At the same time, transmission loss can be reduced since the arithmetic average roughness Ra of the outer peripheral surface of the insulation layer is 10 μm or less.

Figure 19:
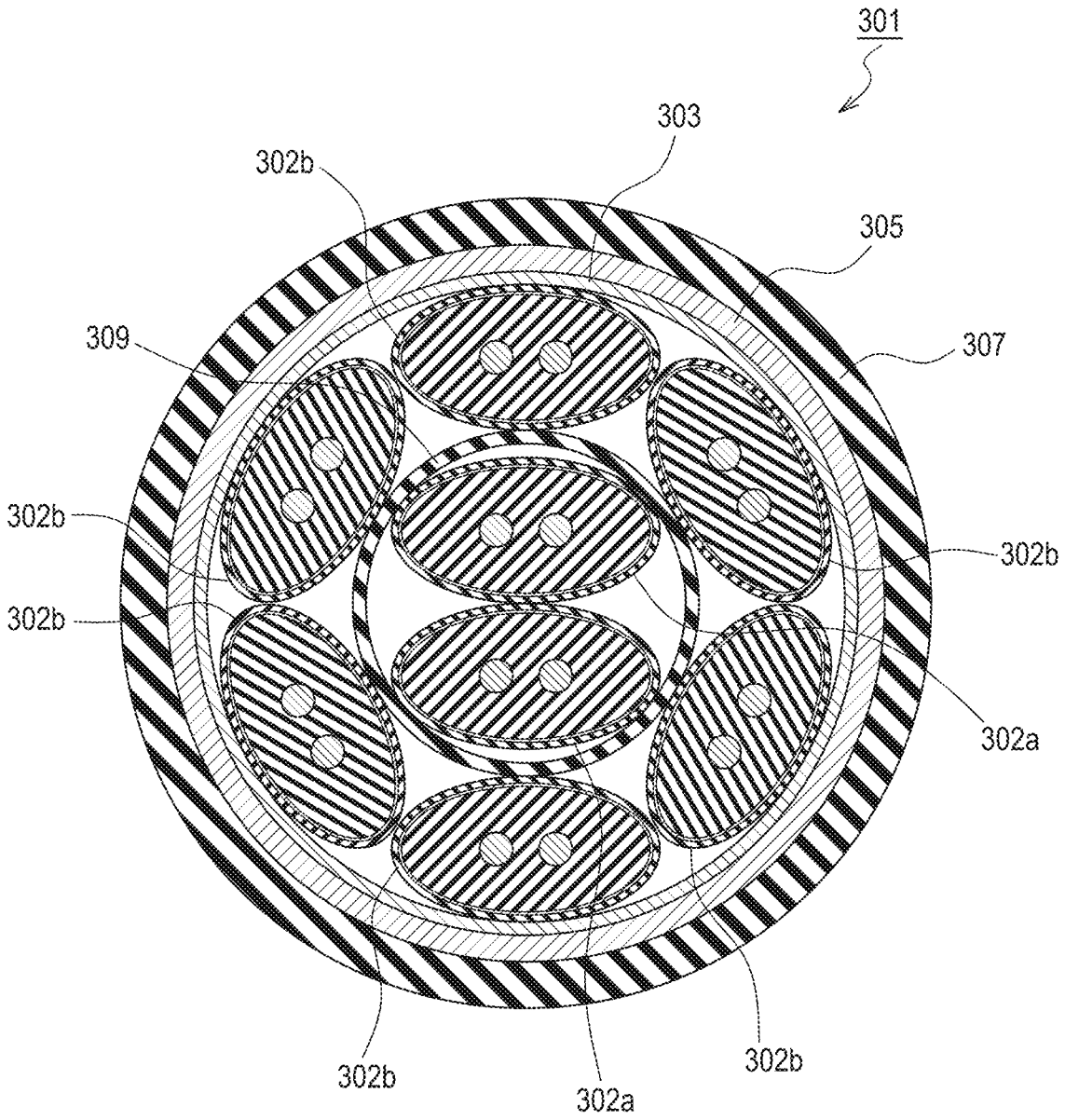
FIG. 19 is a sectional view showing a configuration of a multicore cable 301.

FIG. 19 shows an example of a multicore cable 301. The multicore cable 301 comprises eight differential signal transmission cables 302 (comprising two transmission cables 302*a* and six transmission cables 302*b*), a shield tape conductor 303, a braided wire 305, and a jacket 307. The shield tape conductor 303 and the braided wire 305 both cover the eight differential signal transmission cables 302 collectively. The braided wire 305 is situated around the outer circumference of the shield tape conductor 303. The jacket 307 covers the braided wire 305.

The eight differential signal transmission cables 302 are divided into two groups. The first group is in a central area and comprises two differential signal transmission cables 302*a* and the second group comprises six differential signal transmission cables 302*b* arranged around the first group. An interposition 309 is arranged between the first group and the second group.

Figure 20:
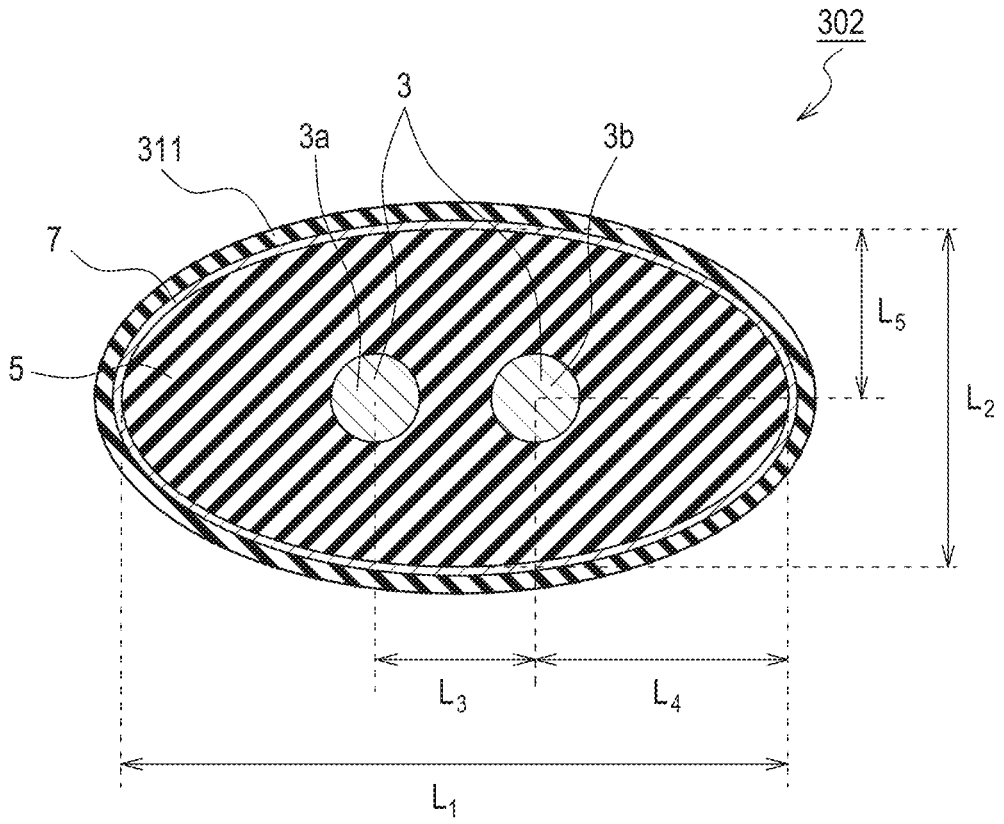
FIG. 20 is a sectional view showing a configuration of a differential signal transmission cable 302 included in the multicore cable 301.

FIG. 20 shows a configuration of each of the eight differential signal transmission cables 302. Each differential signal transmission cable 302 comprises the first and second signal lines 3*a* and 3*b*, the insulation layer 5, the plating layer 7, and the outer insulation layer 311.

The insulation layer 5 covers the first and second signal lines 3*a* and 3*b* collectively. The plating layer 7 covers the insulation layer 5. The outer insulation layer 311 covers the plating layer 7. The maximum value of the differential-to-common mode conversion energy of the differential signal transmission cable 302 is −26 dB or less in the frequency range of 50 GHz and below. The arithmetic average roughness Ra of the outer peripheral surface of the insulation layer 5 is between 0.6 μm and 10 μm inclusive. The configuration of the first and second signal lines 3*a* and 3*b*, the insulation layer 5, and the plating layer 7 are the same as those configurations explained in the previous sections, for example, "1. Signal Transmission Cable".

4. EMBODIMENTS

(4-1) First Embodiment

A differential signal transmission cable 1 according to a first embodiment comprising a configuration shown in FIG. 1 is manufactured. The material for the insulation layer 5 is polyethylene. The insulation layer 5 covers the first and second signal lines 3*a* and 3*b* collectively. The shape of an outer periphery of the insulation layer 5 is elliptical in a section orthogonal to an axis of extention of the first and second signal lines 3*a* and 3*b*. The thickness of the plating layer 7 is 4.56 μm. The standard deviation of the thickness of the plating layer 7 is 0.68 μm. The coefficient of variation of the thickness of the plating layer 7 is 0.15.

As shown in FIG. 20, an outer diameter of the insulation layer 5 along the major axis of the elliptic shape is denoted by $L_1$; an outer diameter of the insulation layer 5 along the minor axis of the elliptic shape is denoted by $L_2$; and the distance between the center of the first signal line 3*a* and the center of the second signal line 3*b* is denoted by $L_3$. Along the major axis, the distance between the center of the second signal line 3*b* and the outer peripheral surface of the insulation layer 5, measured in a direction away from the first signal line 3*a* without crossing the first signal line 3*a*, is denoted by $L_4$. The distance between the center of the first signal line 3*a* and the outer peripheral surface of the insulation layer 5, measured likewise, is also $L_4$. The maximum distance between a straight line running across the centers of the first and second signal lines 3*a* and 3*b* and the outer peripheral surface of the insulation layer 5 measured along the minor axis is denoted with $L_5$.

Similarly, $L_1$ to $L_5$ can be defined in a case where the shape of the outer periphery of the insulation layer 5 is oval. In this case, the major axis is parallel to two straight lines of the outer peripheral surface of the insulation layer 5. In this case, the minor axis is orthogonal to the aforementioned two straight lines.

In the first embodiment, $L_1$ is 2.03 mm, $L_2$ is 1.04 mm; $L_3$ is 0.55 mm; $L_4$ is 0.74 mm; and $L_5$ is 0.52 mm.

The surface roughening treatment was applied to the outer peripheral surface of the insulation layer 5. Chromic acid etching was conducted as the surface roughening treatment. The arithmetic average roughness Ra of the outer peripheral surface of the insulation layer 5 was 0.6 μm before forming the plating layer 7. The contact angle of the outer peripheral surface of the insulation layer 5 was 95° before forming the plating layer 7.

Figure 21:
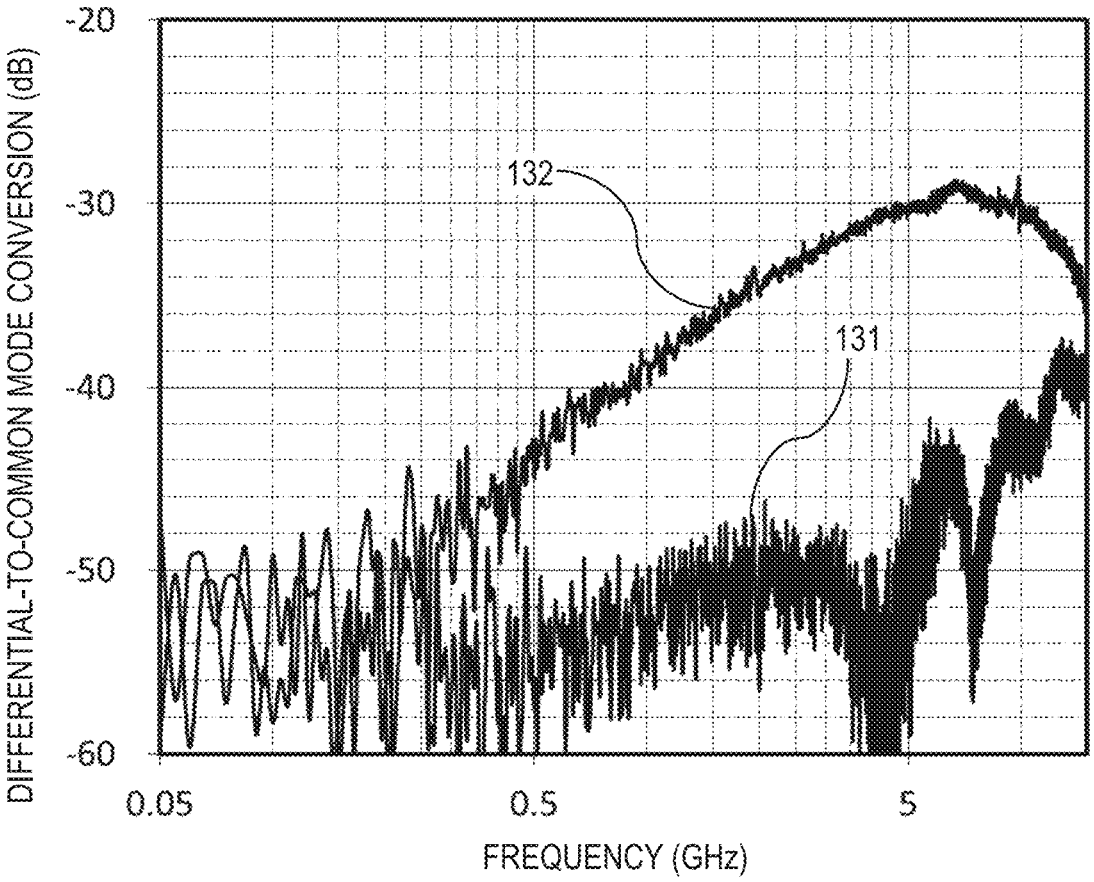
FIG. 21 is a graph showing a differential-to-common mode conversion energy of a differential signal transmission cable 1 and a comparative example.

The differential-to-common mode conversion energy of the differential signal transmission cable 1 according to the first embodiment was measured. The differential-to-common mode conversion energy was measured before winding the differential signal transmission cable around a drum or the like. FIG. 21 shows the result of the measurement with the reference numeral "131". In FIG. 21, the horizontal axis represents frequency in logarithmic scale, and the vertical axis represents the differential-to-common mode conversion energy in decibels (dB). The differential-to-common mode conversion energy in the vertical axis corresponds to Scd21 in mixed-mode S-parameters. The larger the value on the vertical axis is (that is, the smaller the absolute value of a negative measured value is), the greater the amount of noise in the differential-to-common mode conversion energy is. That is, a large value on the vertical axis indicates that decrease of the quality of the transmitted signal is significant.

In addition, the differential-to-common mode conversion energy was also measured with respect to a differential signal transmission cable R in the comparative example. FIG. 21 shows the result of the measurement with the reference numeral "132". The surface modification treatment was not conducted on the outer peripheral surface of the insulation layer of the differential signal transmission cable R in the comparative example. Therefore, the arithmetic average roughness Ra of the outer peripheral surface of the insulation layer was 0.13 μm, and the contact angle of the outer peripheral surface of the insulation layer was 82°. The differential signal transmission cable R in the comparative example does not comprise a plating layer, but comprises a conductor layer of a wound metallic tape.

The differential-to-common mode conversion energy was small in the differential signal transmission cable 1 of the first embodiment compared with that of the differential signal transmission cable R of the comparative example. Significant difference was seen particularly in a high frequency range.

Figure 22:
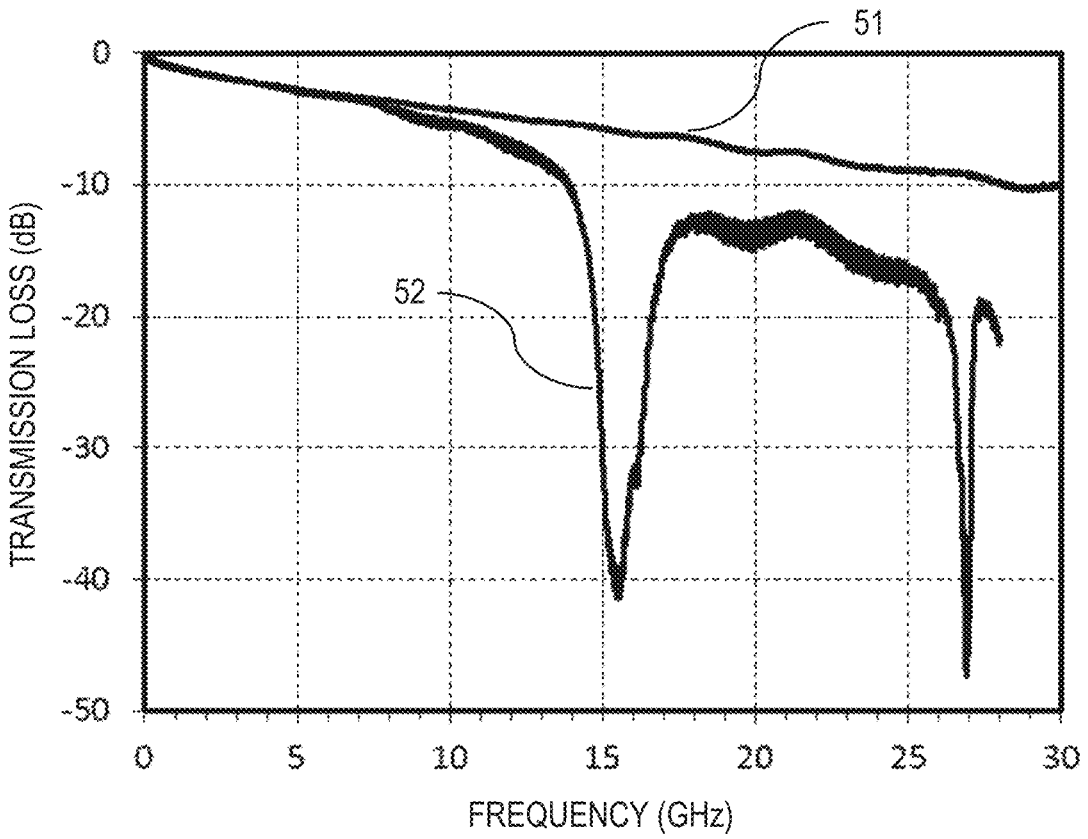
FIG. 22 is a graph showing a transmission loss of the differential signal transmission cable 1 and the comparative example.

The transmission property was measured with respect to the differential signal transmission cable 1 of the first embodiment and the differential signal transmission cable R of the comparative example. The transmission property was measured before winding the differential signal transmission cable around a drum or the like. FIG. 22 shows the result of the measurement of the differential signal transmission cable 1 of the first embodiment with reference numeral "51", and the result of the measurement of the differential signal transmission cable R of the comparative example with reference numeral "52". The horizontal axis in FIG. 22 represents frequency of the transmission signal. The vertical axis represents signal transmission loss in dB. The transmission loss in the vertical axis corresponds to Sdd21 of the mixed-mode S-parameters. FIG. 22 shows that, as the value on the vertical axis decreases (that is, as the absolute value of the negative measured value increases), the attenuation of the transmission signal increases, the degradation due to transmission of signal increases, and the transmission loss becomes more significant.

The transmission loss of the differential signal transmission cable 1 of the first embodiment was less than that of the differential signal transmission cable R of the comparative example. In addition, no suck-out occurred in the differential signal transmission cable 1 of the first embodiment. Although it is not shown in FIG. 22, no suck-out occurred also in the range of between 30 GHz and 50 GHz inclusive. The suck-out is a sudden attenuation of transmission signals.

In contrast, the suck-out occurred in the differential signal transmission cable R of the comparative example. A mechanism that no suck-out occurred in the differential signal transmission cable 1 of the first embodiment is assumed that the plating layer is formed continuously across the entire surface of the differential signal transmission cable 1, causing no overlapping layer or seam that would be seen on the conductor layer of a wound metallic tape.

(4-2) Second Embodiment

The differential signal transmission cables S1 to S7 were manufactured under the conditions shown in Table 4.

TABLE 4

| Sample No. | Pre-treatment | Permanganate treatment | First Ra (μm) | Second Ra (μm) | Average Ra (μm) | 12.89 GHz Sdd21 |
|---|---|---|---|---|---|---|
| S1 | Dry-ice | Applied | 2.97 | 3.56 | 3.27 | −8.15 |
| S2 | blasting + | Applied | 3.23 | 1.49 | 2.36 | −8.14 |
| S3 | Corona | Applied | 0.93 | 1.04 | 0.99 | −7.91 |
| S4 | discharge | Not applied | 4.22 | 3.34 | 3.78 | −8.65 |
| S5 | | Not applied | 1.33 | 1.20 | 1.27 | −8.32 |
| S6 | Chromic acid treatment | — | — | — | 0.60 | −7.80 |
| S7 | Cu taping (lateral winding) | — | — | — | 0.08 | −7.50 |

S1 to S7 each comprises the polyethylene insulation layer. In each of S1 to S7, the shape of the outer periphery of the insulation layer is elliptical in a section orthogonal to an axis of extension of the first and second signal lines 3*a* and 3*b*. In the second embodiment, $L_1$ is 1.21 mm; $L_2$ is 0.62 mm; $L_3$ is 0.35 mm; $L_4$ is 0.43 mm; and $L_5$ is 0.31 mm.

S1 to S6 each comprises an electrically conducting layer constituted by the plating layer. S7 comprises an electrically conducting layer formed by laterally winding a Cu tape. In S1 to S5, the outer peripheral surface of the insulation layer was processed by the dry-ice-blasting, followed by the corona discharge exposure process. The dry-ice-blasting corresponds to the surface roughening treatment. The corona discharge exposure process corresponds to the surface modification treatment. In S1 to S3, the permanganate treatment was conducted after the corona discharge exposure process. In S4 and S5, the permanganate treatment was not conducted after the corona discharge exposure process. In S6, chromic acid treatment was conducted on the outer peripheral surface of the insulation layer. In S7, no pre-treatment was conducted prior to winding the Cu tape.

Figure 23:
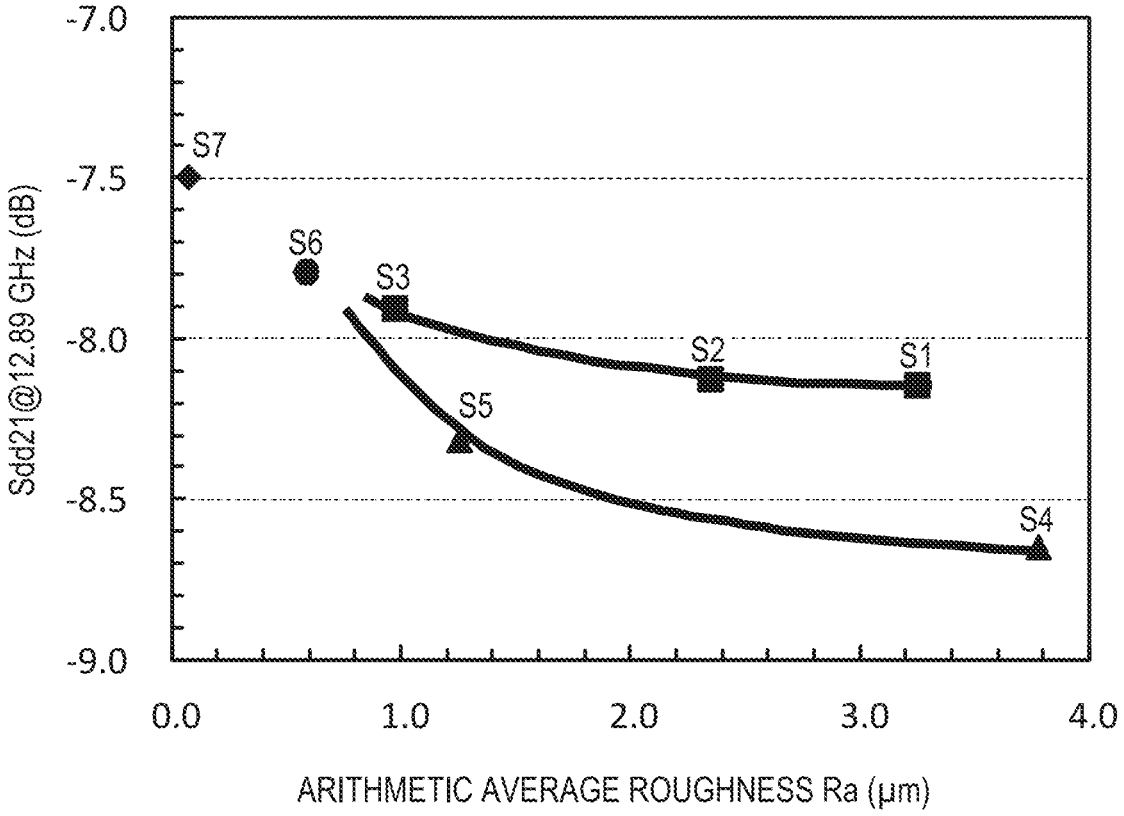
FIG. 23 is a graph showing a relation between an arithmetic average roughness Ra and a transmission loss Sdd21.

Regarding S1 to S7, the arithmetic average roughness Ra and the transmission loss Sdd21 were measured. Table 4 shows the results of the measurement. In Table 4, "First Ra" represents the arithmetic average roughness Ra at the first measuring position; "Second Ra" represents the arithmetic average roughness Ra at the second measuring position; and "Average Ra" represents the average value of First Ra and Second Ra. FIG. 23 shows the relation between the arithmetic average roughness Ra and the transmission loss Sdd21. The transmission loss Sdd21 decreases as the arithmetic average roughness Ra decreases. S1 to S3 applied with the permanganate treatment had less transmission loss than S4 to S5 applied with no permanganate treatment.

5. OTHER EMBODIMENTS

The embodiments of the present disclosure have been explained above. The present disclosure may be achieved in various modifications without being limited to the explained embodiments.

(1) In each of the aforementioned embodiments, one function of one element may be achieved by two or more elements, or two or more functions of two or more elements may be achieved by one element. A part of the configuration of the aforementioned embodiments may be omitted, and at least a part of the configuration of the aforementioned embodiments may be added to or replaced with another part of the aforementioned embodiments. It should be noted that any and all modes encompassed in the technical ideas that are defined by the languages in the claims are embodiments of the present disclosure.

(2) In addition to the aforementioned signal transmission cable and multicore cable, the present disclosure may also be achieved in various forms, such as a system comprising at least one of the aforementioned signal transmission cable or multicore cable, a manufacturing method of the multicore cable, a method of signal transmission and reception using the signal transmission cable.

What is claimed is:

1. A signal transmission cable comprising:

a signal line;

an insulation layer configured to cover the signal line; and a plating layer configured to cover the insulation layer, wherein an arithmetic average roughness Ra of an outer peripheral surface of the insulation layer is between 0.6 μm and 10 μm inclusive;

wherein the insulation layer is made of polyethylene or perfluoroethylene-propene copolymer, wherein when the insulation layer is made of the polyethylene, a crystallinity Xc expressed in following Formula 1 is 0.744 or greater, wherein when the insulation layer is made of the perfluoroethylene-propene copolymer, a crystallinity Xc expressed in the following Formula 1 is 0.47 or less, and $$X_c = \frac{I_c}{I_c + I_a} \quad \text{[Formula 1]}$$

wherein Ic in the Formula 1 is X-ray diffraction intensity of a crystalline component, and Ia is X-ray diffraction intensity of a noncrystalline component.

2. The signal transmission cable according to claim 1, wherein a thickness of the plating layer is between 1 μm and 5 μm inclusive, wherein a standard deviation of the thickness of the plating layer is 0.8 μm or less, and wherein the standard deviation of the thickness of the plating layer is measured by taking four cross sections of the signal line orthogonally to an axis of extension of the signal line, taking four random points on each cross section to make sixteen points in total, and measuring a thickness of the plating layer at each of the sixteen points and obtain a standard deviation, which is used as the standard deviation of the thickness of the plating layer.

3. The signal transmission cable according to claim 1, wherein a contact angle on the outer peripheral surface of the insulation layer is 95° or less.

4. The signal transmission cable according to claim 1, wherein an absolute value of adhesion-wetting surface free energy on the outer peripheral surface of the insulation layer is 66 mJ/m$^2$ or greater.

5. The signal transmission cable according to claim 1, wherein the outer peripheral surface of the insulation layer comprises a concavity, and wherein the concavity comprises, at its bottom in a depth direction, a space that is wider than an opening of the concavity.

6. A multicore cable comprising:

signal transmission cables;

a conductor layer configured to cover the signal transmission cables collectively; and a jacket configured to cover the conductor layer, wherein each of the signal transmission cables comprises the signal transmission cable according to claim 1 and an outer insulation layer configured to cover the plating layer.

7. A signal transmission cable comprising, a signal line;

an insulation layer configured to cover the signal line; and a plating layer configured to cover the insulation layer, wherein an arithmetic average roughness Ra of an outer peripheral surface of the insulation layer is between 0.6 μm and 10 μm inclusive;

wherein the insulation layer is made of polyethylene, wherein the polyethylene has crystal structures of the triclinic crystal system or of the orthorhombic system, or has a coexisting state of at least one of these crystal structures, wherein the polyethylene has preferential crystalline orientations in specific two or less number of crystal axes, wherein a (100) crystal orientation degree $O_{100}$ of the polyethylene expressed in the following Formula 2 is 0.26 or less, and $$O_{100} = \frac{I_{200}}{I_{110} + I_{200}} \quad \text{[Formula 2]}$$

wherein $I_{200}$ in the Formula 2 is X-ray diffraction intensity of the index 200, and $I_{110}$ is X-ray diffraction intensity of the index 110.

8. The signal transmission cable according to claim 7, wherein a contact angle on the outer peripheral surface of the insulation layer is 95° or less.

9. The signal transmission cable according to claim 7, wherein an absolute value of adhesion-wetting surface free energy on the outer peripheral surface of the insulation layer is 66 mJ/m$^2$ or greater.

10. The signal transmission cable according to claim 7, wherein the outer peripheral surface of the insulation layer comprises a concavity, and wherein the concavity comprises, at its bottom in a depth direction, a space that is wider than an opening of the concavity.

11. A multicore cable comprising:

signal transmission cables;

a conductor layer configured to cover the signal transmission cables collectively; and a jacket configured to cover the conductor layer, wherein each of the signal transmission cables comprises the signal transmission cable according to claim 7 and an outer insulation layer configured to cover the plating layer.

12. The signal transmission cable comprising, a signal line;

an insulation layer configured to cover the signal line; and a plating layer configured to cover the insulation layer, wherein an arithmetic average roughness Ra of an outer peripheral surface of the insulation layer is between 0.6 μm and 10 μm inclusive wherein the insulation layer is made of polyethylene or perfluoroethylene-propene copolymer, wherein when the insulation layer is made of the polyethylene, the polyethylene has a crystalline size of 18 nm or greater in a crystalline component, and wherein when the insulation layer is made of the perfluoroethylene-propene copolymer, the perfluoroethylene-propene copolymer has a crystalline size of 13.6 nm or less in a crystalline component.

13. The signal transmission cable according to claim 12, wherein a contact angle on the outer peripheral surface of the insulation layer is 95° or less.

14. The signal transmission cable according to claim 12, wherein an absolute value of adhesion-wetting surface free energy on the outer peripheral surface of the insulation layer is 66 $mJ/m^2$ or greater.

15. The signal transmission cable according to claim 12, wherein the outer peripheral surface of the insulation layer comprises a concavity, and wherein the concavity comprises, at its bottom in a depth direction, a space that is wider than an opening of the concavity.

16. A multicore cable comprising:

signal transmission cables;

a conductor layer configured to cover the signal transmission cables collectively; and a jacket configured to cover the conductor layer, wherein each of the signal transmission cables comprises the signal transmission cable according to claim 12 and an outer insulation layer configured to cover the plating layer.

17. A method of manufacturing a signal transmission cable comprising a signal line, an insulation layer configured to cover the signal line, and a plating layer configured to cover the insulation layer, the method comprising:

conducting dry-ice-blasting on an outer peripheral surface of the insulation layer, followed by conducting a surface modification treatment on the outer peripheral surface, and forming the plating layer on the outer peripheral surface.

18. The method of manufacturing the signal transmission cable according to claim 17, wherein an arithmetic average roughness Ra of the outer peripheral surface of the insulation layer is between 0.6 μm and 10 μm inclusive after the dry-ice-blasting is conducted.

19. The method of manufacturing the signal transmission cable according to claim 17, wherein the surface modification treatment is a corona discharge exposure process.

20. The method of manufacturing the signal transmission cable according to claim 17, wherein the surface modification treatment comprises one or more of an electron beam irradiation, an ion irradiation, a corona discharge exposure, a plasma exposure, a ultraviolet irradiation, an X-ray irradiation, a γ-ray irradiation, and an immersion in ozone-containing liquid.

* * * * *